US006845360B2

(12) United States Patent
Jensen et al.

(10) Patent No.: US 6,845,360 B2
(45) Date of Patent: Jan. 18, 2005

(54) ENCODING MULTIPLE MESSAGES IN AUDIO DATA AND DETECTING SAME

(75) Inventors: James M. Jensen, Columbia, MD (US); Alan R. Neuhauser, Silver Spring, MD (US)

(73) Assignee: Arbitron Inc., Columbia, MD (US)

( * ) Notice: Subject to any disclaimer, the term of this patent is extended or adjusted under 35 U.S.C. 154(b) by 284 days.

(21) Appl. No.: 10/302,309

(22) Filed: Nov. 22, 2002

(65) Prior Publication Data

US 2004/0102961 A1 May 27, 2004

(51) Int. Cl.[7] ..... G10L 19/00
(52) U.S. Cl. ..... 704/500; 341/52
(58) Field of Search ..... 704/500, 201; 341/3, 52

(56) References Cited

U.S. PATENT DOCUMENTS

| | | | | |
|---|---|---|---|---|
| 4,942,607 A | | 7/1990 | Schroder et al. | 381/31 |
| 5,319,735 A | | 6/1994 | Preuss et al. | 395/2.14 |
| 5,379,345 A | | 1/1995 | Greenberg | 380/23 |
| 5,425,100 A | | 6/1995 | Thomas et al. | 380/20 |
| 5,579,124 A | | 11/1996 | Aijala et al. | 386/96 |
| 5,581,800 A | * | 12/1996 | Fardeau et al. | 455/2.01 |
| 5,687,191 A | | 11/1997 | Lee et al. | 375/216 |
| 5,758,315 A | | 5/1998 | Mori | 704/229 |
| 5,764,763 A | | 6/1998 | Jensen et al. | 380/6 |
| 5,768,680 A | | 6/1998 | Thomas | 455/2 |
| 5,828,325 A | | 10/1998 | Wolesewicz et al. | 341/52 |
| 5,848,391 A | | 12/1998 | Bosi et al. | 704/500 |
| 5,945,932 A | | 8/1999 | Smith et al. | 341/51 |
| 6,154,484 A | | 11/2000 | Lee et al. | 375/130 |
| 6,175,627 B1 | | 1/2001 | Petrovic et al. | 380/42 |
| 6,424,939 B1 | * | 7/2002 | Herre et al. | 704/219 |
| 6,754,633 B1 | * | 6/2004 | Yin | 704/273 |

FOREIGN PATENT DOCUMENTS

| | | |
|---|---|---|
| WO | WO 96/27264 | 9/1996 |
| WO | WO 98/26529 | 6/1998 |
| WO | WO 99/59275 | 11/1999 |
| WO | WO 00/04662 | 1/2000 |
| WO | WO 00/72309 | 11/2000 |

* cited by examiner

*Primary Examiner*—Daniel Abebe
(74) *Attorney, Agent, or Firm*—Cowan, Liebowitz & Latman, P.C.; Eugene L. Flanagan, III

(57) ABSTRACT

Systems and methods are provided for encoding and decoding multiple messages in audio data. The messages each comprise a sequence of message symbols each comprising a combination of substantially single-frequency components. At least some of the message symbols in one of the messages coexist with at least some of the symbols of another one of the messages along a time base of the audio data.

144 Claims, 13 Drawing Sheets

| A | B | C | D |
|---|---|---|---|
| $f_1$ | $f_2$ | $f_3$ | $f_4$ |
| $f_5$ | $f_6$ | $f_7$ | $f_8$ |
| $f_9$ | $f_{10}$ | $f_{11}$ | $f_{12}$ |
| $f_{13}$ | $f_{14}$ | $f_{15}$ | $f_{16}$ |

FIGURE 2C

| J | K | L | M |
|---|---|---|---|
| $f_1$ | $f_2$ | $f_3$ | $f_4$ |
| $f_6$ | $f_7$ | $f_8$ | $f_5$ |
| $f_{11}$ | $f_{12}$ | $f_9$ | $f_{10}$ |
| $f_{16}$ | $f_{13}$ | $f_{14}$ | $f_{15}$ |

FIGURE 2D

ENCODING MULTIPLE MESSAGES IN AUDIO DATA AND DETECTING SAME

FIELD OF THE INVENTION

The present invention relates to apparatus and methods for including multiple overlapping encoded messages in audio data and decoding such encoded messages.

BACKGROUND OF THE INVENTION

There are many reasons to encode an inaudible message in audio data and many groups would like to have access to such technology. A group with such an interest is the group of copyright owners. Copyright owners would like such an encoding technique to facilitate copyright enforcement and protection. Copyright enforcement would be facilitated by encoding pieces of copyrighted works with a watermark to provide ownership information for copyright enforcement. Alternatively, the copyrights of a work may be protected by a copy protection scheme, e.g. encryption keys encoded onto the audio data, which would prevent unauthorized use of the protected matter.

Another group with an interest in using inaudible messages encoded into audio data would be the group of audio listeners. The encoding would provide listeners with useful information about the programs they are listening to without affecting the audio experience. For example, the names of the performers, the name of the performance, or the name of the broadcaster may be given and relayed to the listener via the listener's receiver.

Still another group with an interest in the encoding of inaudible messages into audio data would be market researchers who make use of audience estimating techniques, as well as customer loyalty programs, commercial verification functionality and program identification. Inaudible messages encoded into broadcast or recorded audio are particularly useful in implementing such techniques and activities.

Yet still another group with an interest in the encoding of inaudible messages into audio data would be those seeking additional bandwidth to communicate data that is totally unrelated to the audio data. For example, telecommunications companies could utilize the bandwidth to carry their data and/or news organizations could relay real time news such as breaking headlines or stock quotes.

There are many other good reasons that other interested groups have for the encoding of inaudible messages into audio data. One problem encounterd in attempting to encode multiple messages inaudibly within audio data is that there is only a limited amount of bandwidth available for this purpose.

The limited bandwidth is due to the fact that audio data can only receive a finite amount of energy in the encoding process before the encoding becomes audible. This level of acceptable ancillary data energy in audio data is application dependent. For example, in high fidelity applications such as music distribution or broadcasting, the messages must be keep inaudible. However, in certain other applications such as voice data communication, e.g. cell phone communications, the constraints on the amount of acceptable ancillary data energy in the audio data are less rigorous. The bandwidth limitations due to these constraints are further restricted by the administrative load imposed by error detection and correction data, marker data, sync data, address data and the like.

A further problem arises in applications requiring the encoding of one or more messages in audio data that is already encoded with another message. This is desired in certain broadcast and recording applications, such as audience measurement, commercial and network clearance, and content identification. It has been proposed to reserve different respective time intervals along the time base of the audio data for encoding of plural messages at various levels of distribution (for example, at the production level, the network level and the local affiliate level). Such time division multiplexing of encoded messages substantially restricts bandwidth available for each of the messages and requires a reliable means of determining in each case the permissible time interval for inserting each different message.

Accordingly, what is needed is a way to encode multiple messages inaudibly in audio data in which one or more such messages are encoded in the audio data at different times and/or levels of distribution which achieves desirably high bandwidth and is easily implemented.

It is also desired to provide expanded data communication capability in the limited bandwidth available for ancillary data in an audio channel. It is desired, therefore, to increase the bandwidth afforded by an audio channel to communicate information in the form of ancillary data encoded in the audio data, so that the encoded ancillary data remains inaudible or beneath an acceptable level of audibility when the audio data is reproduced acoustically.

SUMMARY OF THE INVENTION

For this application the following terms and definitions shall apply, both for the singular and plural forms of nouns and for all verb tenses:

The term "data" as used herein means any indicia, signals, marks, domains, symbols, symbol sets, representations, and any other physical form or forms representing information, whether permanent or temporary, whether visible, audible, acoustic, electric, magnetic, electromagnetic, or otherwise manifested. The term "data" as used to represent particular information in one physical form shall be deemed to encompass any and all representations of the same particular information in a different physical form or forms.

The term "audio data" as used herein means any data representing acoustic energy, including, but not limited to, audible sounds, regardless of the presence of any other data, or lack thereof, which accompanies, is appended to, is superimposed on, or is otherwise transmitted or able to be transmitted with the audio data.

The term "processor" as used herein means data processing devices, apparatus, programs, circuits, systems, and subsystems, whether implemented in hardware, software, or both, and whether used to process data in analog or digital form.

The terms "communicate" and "communicating" as used herein include both conveying data from a source to a destination, as well as delivering data to a communications medium, system or link to be conveyed to a destination. The term "communication" as used herein means the act of communicating or the data communicated, as appropriate.

The terms "coupled", "coupled to", and "coupled with" as used herein each mean a relationship between or among two or more devices, apparatus, files, programs, media, components, networks, systems, subsystems, and/or means, constituting any one or more of (a) a connection, whether direct or through one or more other devices, apparatus, files, programs, media, components, networks, systems, subsystems, or means, (b) a communications relationship, whether direct or through one or more other devices, apparatus, files, programs, media, components, networks, systems, subsystems, or means, or (c) a functional relationship in which the operation of any one or more of the relevant devices, apparatus, files, programs, media, components, networks, systems, subsystems, or means depends, in whole or in part, on the operation of any one or more others thereof.

In accordance with an aspect of the present invention, a method is provided for encoding audio data with a message, the audio data having a preexisting message encoded therein comprising a sequence of preexisting message symbols, the preexisting message symbols each comprising a distinguishable combination of substantially single-frequency components having frequencies selected from a predefined set of substantially single-frequency values. The method comprises: providing data defining a plurality of further message symbols each comprising a combination of substantially single-frequency components selected from the predefined set of substantially single-frequency values distinguishable from the combinations of all others of the further message symbols; at least some of the substantially single-frequency components included in the further message symbols having the same frequency as at least some of the substantially single-frequency components included in the preexisting message symbols; and encoding the audio data with a further message comprising a sequence of the further message symbols such that at least some of the further message symbols of the further message coexist with at least some of the preexisting message symbols of the preexisting message along a time base of the audio data.

In accordance with a further aspect of the present invention, a method is provided for encoding audio data with a message, the audio data having a preexisting message therein comprising a sequence of preexisting message symbols, the preexisting message symbols each comprising a combination of substantially single-frequency components having frequencies selected from a predefined set of substantially single-frequency values and a predefined symbol interval within a time base of the audio data. The method comprises: providing data defining a plurality of further message symbols each comprising a combination of substantially single-frequency values selected from a predefined set of substantially single-frequency values; and encoding the audio data with a further message comprising a sequence of the further message symbols such that at least some of the further message symbols of the further message coexist with at least some of the preexisting message symbols of the preexisting message along the time base of the audio data; the further message as encoded being arranged within the time base of the audio data so that: (a) the further message symbols have symbol intervals differing from the symbol intervals of the preexisting message symbols; (b) the further message has a time offset with respect to the preexisting message; and/or (c) the further message has a duration differing from a duration of the preexisting message.

In accordance with another aspect of the present invention, a method is provided for encoding audio data with first and second messages each comprising a sequence of first and second message symbols, respectively, each comprising a combination of substantially single-frequency components having a frequency selected from a predefined set of substantially single-frequency values, comprising: providing data defining the first and second message symbols each comprising a combination of substantially single-frequency components selected from the predefined set of substantially single-frequency values distinguishable from the combinations of all others of the first and second message symbols; at least some of the substantially single-frequency components included in the first message symbols having the same frequency as at least some of the substantially single-frequency components included in the second message symbols; and encoding the audio data with the first and second messages each comprising a sequence of the first and second message symbols, respectively, such that at least some of the first message symbols of the first message coexist with at least some of the second message symbols of the second message along a time base of the audio data.

In accordance with a still further aspect of the present invention, a method is provided for encoding audio data with a message, the audio data having a preexisting message encoded therein comprising a sequence of preexisting message symbols in a first predetermined format, the preexisting message symbols each comprising a distinguishable combination of substantially single-frequency components selected from a predefined set of substantially single-frequency values. The method comprises: detecting the first predetermined format of the preexisting message symbols; selecting a second predetermined format for encoding a further message in the audio data comprising a sequence of further message symbols so that the second predetermined format of the further message symbols differs from the first predetermined format of the preexisting message symbols, each of the further message symbols comprising a distinguishable combination of substantially single-frequency components selected from the predefined set; and encoding the audio data with the further message symbols in the second predetermined format so that at least some of the further message symbols of the further message symbols coexist with at least some of the preexisting message symbols of the preexisting message along a time base of the audio data.

In accordance with still another aspect of the present invention, a method is provided for detecting a first message and a second message encoded in audio data as a sequence of first and second message symbols, respectively, at least some of the first message symbols coexisting with at least some of the second message symbols along a time base of the audio data, each of the first and second message symbols comprising a combination of substantially single-frequency components having frequencies selected from a predefined set of substantially single-frequency values, the first message being distinguished from the second message by at least one of (a) differing message symbol intervals along the time base of the audio signal, (b) differing message lengths along the time base of the audio signal, and (c) an offset of the first message from the second message along the time base of the audio signal. The method comprises: detecting the first message symbols based on the at least one of differing message symbol intervals of the first and second messages, differing message lengths of the first and second messages and an offset of the first message from the second message; and detecting the second message symbols based on the at least one of differing message symbol intervals of the first and second messages, differing message lengths of the first and second messages and an offset of the first message from the second message.

In accordance with a still further aspect of the present invention, a method is provided for encoding audio data with first and second messages each comprising a sequence of first and second message symbols, respectively. The method comprises: providing data defining the first and a second message symbols to comprise a combination of substantially single-frequency values selected from a predefined set of substantially single-frequency values; and encoding the audio data with the sequences of first and second message symbols of the first and second messages such that at least some of the first and second message symbols coexist along a time base of the audio data; the sequences of first and second message symbols as encoded being arranged within the time base of the audio data so that: (a) the first message symbols have symbol intervals differing from symbol intervals of the second message symbols; (b) the first message has a time offset with respect to the second message; and/or (c) the first message has a duration differing from the duration of the second message.

In accordance with yet still another aspect of the present invention, a method is provided for detecting a first message and a second message encoded in audio data as a sequence of first and second message symbols, respectively, at least some of the first message symbols coexisting with at least some of the second message symbols along a time base of the audio data, each of the first and second message symbols comprising a combination of substantially single-frequency components having frequencies selected from a predefined set of substantially single-frequency values, at least some of the substantially single-frequency components included in the first message symbols having the same frequency as at least some of the substantially single-frequency components included in the second message symbols. The method comprises: detecting the substantially single-frequency components of the first message symbols, including the substantially single-frequency components thereof having the same frequency as components included in the second message symbols; detecting the first message symbols based on the detected substantially single-frequency components thereof; detecting the substantially single-frequency components of the second message symbols, including the substantially single-frequency components thereof having the same frequency as components included in the first message symbols; and detecting the second message symbols based on the detected substantially single-frequency components thereof.

In accordance with a yet still further aspect of the present invention, a system is provided for encoding audio data with a message, the audio data having a preexisting message encoded therein comprising a sequence of preexisting message symbols, the preexisting message symbols each comprising a distinguishable combination of substantially single-frequency components having frequencies selected from a predefined set of substantially single-frequency values. The system comprises: means for providing data defining a plurality of further message symbols each comprising a combination of substantially single-frequency components selected from the predefined set of substantially single-frequency values distinguishable from the combinations of all others of the further message symbols; at least some of the substantially single-frequency components included in the further message symbols having the same frequency as at least some of the substantially single-frequency components included in the preexisting message symbols; and means for encoding the audio data with a further message comprising a sequence of the further message symbols such that at least some of the further message symbols of the further message coexist with at least some of the preexisting message symbols of the preexisting message along a time base of the audio data.

In accordance with another aspect of the present invention, a system is provided for encoding audio data with a message, the audio data having a preexisting message therein comprising a sequence of preexisting message symbols, the preexisting message symbols each comprising a combination of substantially single-frequency components having frequencies selected from a predefined set of substantially single-frequency values and a predefined symbol interval within a time base of the audio data. The system comprises: means for providing data defining a plurality of further message symbols each comprising a combination of substantially single-frequency values selected from a predefined set of substantially single-frequency values; and means for encoding the audio data with a further message comprising a sequence of the further message symbols such that at least some of the further message symbols of the further message coexist with at least some of the preexisting message symbols of the preexisting message along the time base of the audio data; the further message as encoded being arranged within the time base of the audio data so that: (a) the further message symbols have symbol intervals differing from the symbol intervals of the preexisting message symbols; (b) the further message has a time offset with respect to the preexisting message; and/or (c) the further message has a duration differing from a duration of the preexisting message.

In accordance with yet another aspect of the present invention, a system is provided for encoding audio data with first and second messages each comprising a sequence of first and second message symbols, respectively, each comprising a combination of substantially single-frequency components having a frequency selected from a predefined set of substantially single-frequency values. The system comprises: means for providing data defining the first and second message symbols each comprising a combination of substantially single-frequency components selected from the predefined set of substantially single-frequency values distinguishable from the combinations of all others of the first and second message symbols; at least some of the substantially single-frequency components included in the first message symbols having the same frequency as at least some of the substantially single-frequency components included in the second message symbols; and means for encoding the audio data with the first and second messages each comprising a sequence of the first and second message symbols, respectively, such that at least some of the first message symbols of the first message coexist with at least some of the second message symbols of the second message along a time base of the audio data.

In accordance with yet still another aspect of the present invention, a system is provided for encoding audio data with a message, the audio data having a pre-existing message encoded therein comprising a sequence of preexisting message symbols in a first predetermined format, the preexisting message symbols each comprising a distinguishable combination of substantially single-frequency components selected from a predefined set of substantially single-frequency values. The system comprises: means for detecting the first predetermined format of the preexisting message symbols; means for selecting a second predetermined format for encoding a further message in the audio data comprising a sequence of further message symbols so that the second predetermined format of the further message symbols differs from the first predetermined format of the preexisting message symbols, each of the further message symbols comprising a distinguishable combination of substantially single-frequency components selected from the predefined set; and means for encoding the audio data with the further message symbols in the second predetermined format so that at least some of the further message symbols of the further message coexist with at least some of the preexisting message symbols of the pre-existing message along a time base of the audio data.

In accordance with a further aspect of the present invention, a system is provided for detecting a first message and a second message encoded in audio data as a sequence of first and second message symbols, respectively, at least some of the first message symbols coexisting with at least some of the second message symbols along a time base of the audio data, each of the first and second message symbols comprising a combination of substantially single-frequency components having frequencies selected from a predefined set of substantially single-frequency values, the first message being distinguished from the second message by at least one of (a) differing message symbol intervals along the time base of the audio signal, (b) differing message lengths along the time base of the audio signal, and (c) an offset of the first message from the second message along the time base of the audio signal, comprising: means for detecting the first message symbols based on the at least one of differing message symbol intervals of the first and second messages, differing message lengths of the first and second messages and an offset of the first message from the second message; and means for detecting the second message symbols based on the at least one of differing message symbol intervals of the first and second messages, differing message lengths of the first and second messages and an offset of the first message from the second message.

In accordance with a still further aspect of the present invention, a system is provided for encoding audio data with first and second messages each comprising a sequence of first and second message symbols, respectively. The system comprises: means for providing data defining the first and second message symbols to comprise a combination of substantially single-frequency values selected from a predefined set of substantially single-frequency values; and means for encoding the audio data with the sequences of first and second message symbols of the first and second messages such that at least some of the first and second message symbols coexist along a time base of the audio data; the sequences of first and second message symbols as encoded being arranged within the time base of the audio data so that: (a) the first message symbols have symbol intervals differing from symbol intervals of the second message symbols; (b) the first message has a time offset with respect to the second message; and/or (c) the first message has a duration differing from the duration of the second message.

In accordance with a yet still further aspect of the present invention, a system is provided for detecting a first message and a second message encoded in audio data as a sequence of first and second message symbols, respectively, at least some of the first message symbols coexisting with at least some of the second message symbols along a time base of the audio data, each of the first and second message symbols comprising a combination of substantially single-frequency components having frequencies selected from a predefined set of substantially single-frequency values, at least some of the substantially single-frequency components included in the first message symbols having the same frequency as at least some of the substantially single-frequency components included in the second message symbols. The system comprises: means for detecting the substantially single-frequency components of the first message symbols, including the substantially single-frequency components thereof having the same frequency as components included in the second message symbols; means for detecting the first message symbols based on the detected substantially single-frequency components thereof; means for detecting the substantially single-frequency components of the second message symbols, including the substantially single-frequency components thereof having the same frequency as components included in the first message symbols; and means for detecting the second message symbols based on the detected substantially single-frequency components thereof.

The invention and its particular features and advantages will become more apparent from the following detailed description considered with reference to the accompanying drawings.

BRIEF DESCRIPTION OF THE DRAWINGS

FIGS. 2C and 2D illustrate exemplary schemes for assigning substantially single-frequency components to the symbols of the first and second messages of FIGS. 2A and 2B;

DETAILED DESCRIPTION OF CERTAIN ADVANTAGEOUS EMBODIMENTS

Methods and systems are provided for encoding multiple messages in audio data. In certain embodiments one or more such messages are encoded into audio data having a previously encoded message therein. In certain other embodiments, two or more messages are encoded into audio data that contains no previously encoded message. Each of two or more messages encoded in the same time interval of the audio data has a different format or symbol set to enable the messages to be separately decoded. Each such different format or symbol set characterizes a distinct separately decodable message space or message layer.

In certain embodiments of the invention, multiple messages are encoded in compressed audio data. In particular ones of these embodiments the encoding of compressed audio is accomplished by modifying existing frequency representations of the audio data. In certain embodiments uncompressed audio data is encoded.

Embodiments of the invention are provided to encode multiple messages in audio data in the frequency domain in any of multiple formats, e.g. compressed or uncompressed, whether previously encoded or unencoded. Embodiments are also provided to encode multiple messages into audio data in the time domain in any of multiple formats, e.g. compressed or uncompressed, and whether previously encoded or unencoded.

Certain embodiments encode multiple simultaneous messages while reusing frequency components selected from the same set of frequencies by assigning the reused frequency components in different combinations in the two different message layers. By reusing frequency components, the system's bandwidth increases because more symbols may be encoded in a given interval of the audio data.

In certain embodiments, one or more messages are encoded in audio data having one or more messages encoded therein, utilizing different message lengths for the various messages, differing symbol intervals in different messages, differing offsets of the various messages from one another and/or different combinations of frequency components assigned to their respective symbols. In certain embodiments the multiple messages are detected based on their differing message lengths, differing symbol intervals, differing message offsets and/or symbol frequency component combinations.

In certain embodiments, encoded messages that share frequency components are decoded. The decoder accumulates the energy for each message symbol into a buffer and then uses a predetermined symbol/frequency component combination relationship to interpret the accumulated energy in the buffer thereby identifying the substantially single-frequency components. Once the substantially single-frequency components are identified, the symbol and then the message can be reconstructed.

Figure 1:
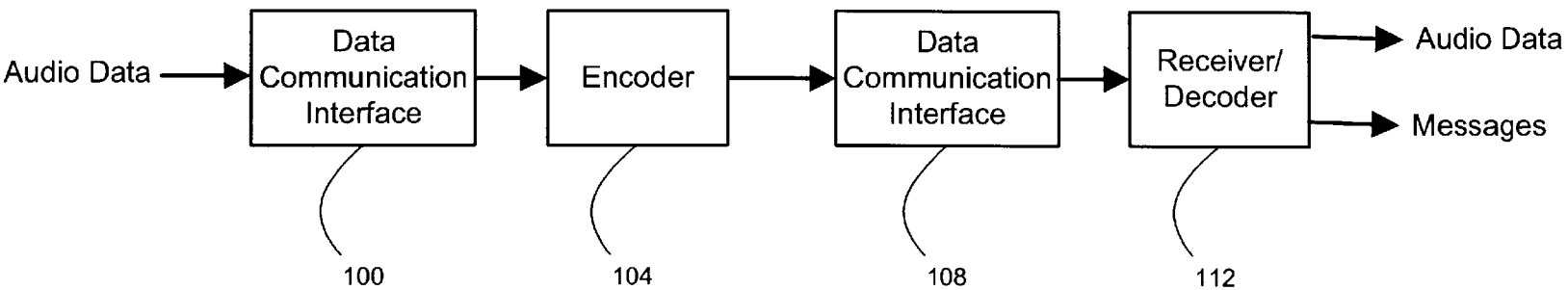
FIG. 1 is a functional block diagram of a communications system incorporating an encoder and receiver/decoder in accordance with certain embodiments of the present invention.

FIG. 1 is an overview of encoding and decoding processes and systems in accordance with certain embodiments of the invention. The audio data represented in FIG. 1 can come in many forms. The audio data can be in a compressed or uncompressed format. The audio data can be previously encoded or unencoded. The audio data can be represented in the time domain or the frequency domain. The audio data can also have any combination of the foregoing audio data forms.

Audio data, regardless of its form as described above, enters the system through a communications interface 100. This communications interface 100 utilizes any of the readily available technologies such as a serial port, parallel port, coaxial cable, twisted wire, infrared port, optical cable, microwave link, rf, wireless port, satellite link or the like.

The audio data then enters encoder 104 from communications interface 100. In encoder 104, in one mode of operation the audio data is encoded with multiple messages that share substantially single-frequency components. In another, the audio data as received by encoder 104 has a message encoded therein and encoder 104 encodes one or more additional messages in the audio data. The encoded audio data is then communicated via a communication interface 108. The communication interface 108 can come in any of multiple forms such as radio broadcasts, television broadcasts, DVDs, MP3s, compact discs, streaming music, streaming video, network data, mini-discs, multimedia presentations, VHS tapes, personal address systems or the like. Receiver 112 then receives the communicated encoded audio data.

Receiver 112 possesses a decoder to detect the encoded messages. As a result of the ability to retrieve the encoded messages, the receiver 112 can therefore possess a myriad of functionality. Functionality such as the relaying of information, e.g. providing the performing artist's name or providing audience estimating information, or controlling access, e.g. an encryption key scheme, or data transport, e.g. using the encoded messages as an alternate communications channel. The receiver 112 can possess the ability to reproduce the audio data but this is not essential. For example, a receiver 112 used for gathering audience estimate data can receive the audio data in acoustic form, in electrical form or otherwise from a separate receiver. In the case of an encryption key scheme, the reproduction of the audio data for an encryption key holder is the objective.

Figure 2:
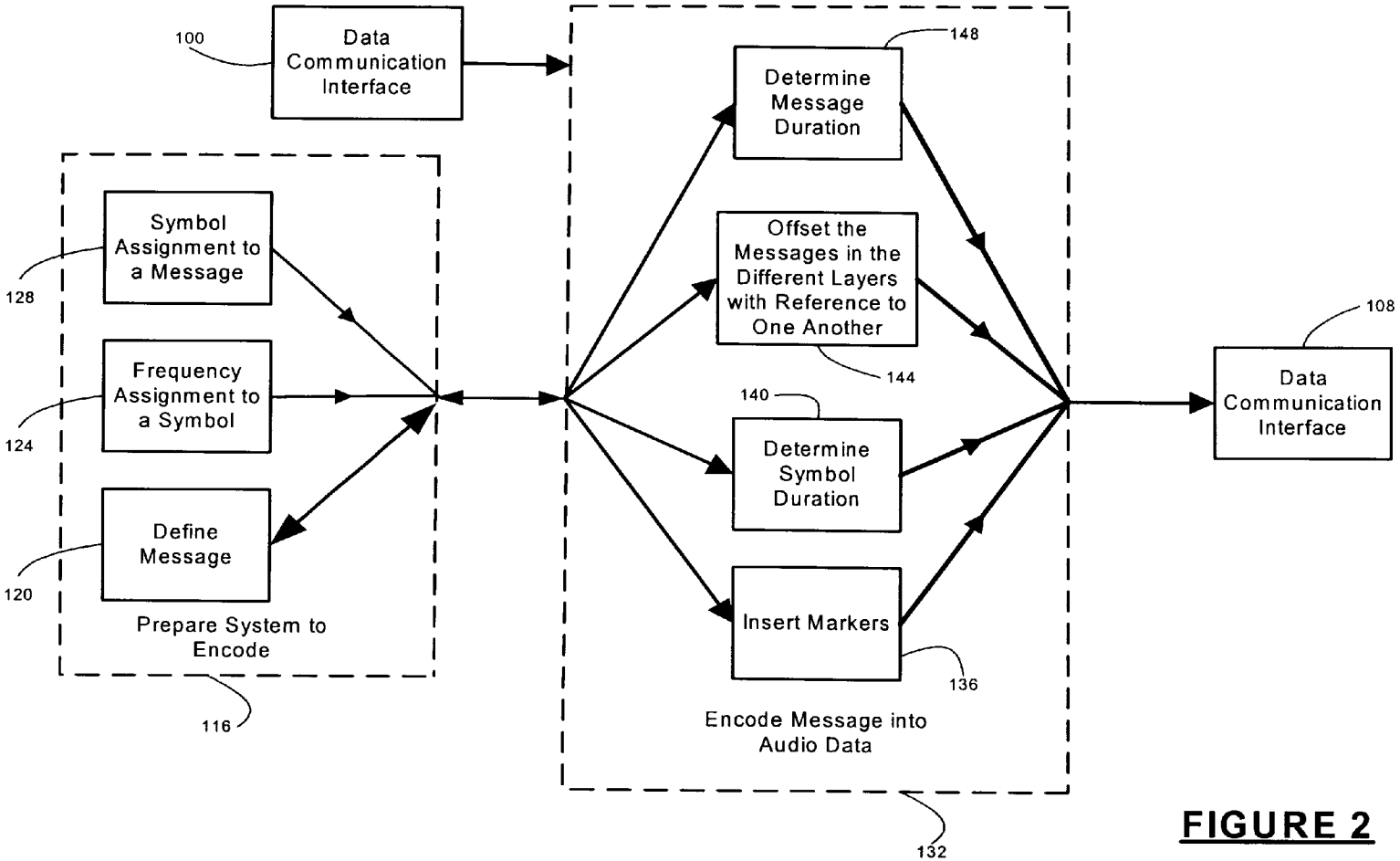
FIG. 2 is an overview of an encoding process in accordance with certain embodiments of the present invention.

FIG. 2 is an overview of encoding processes and systems according to certain embodiments of the invention. Block 116 illustrates a number of preliminary operations 120, 124 and 128 which are carried out in preparation for encoding one or more messages into audio data. As indicated by operation 120, the content of a message to be encoded is defined. In certain embodiments this is achieved by selecting from a plurality of predefined messages, while in others the content of the message is defined through a user input or by data received from a further system. In still others the identity of the message content is fixed.

Once the content of the message is known, a sequence of symbols is assigned to represent the message as indicated at 128. The symbols are selected from a predefined set or alphabet of code symbols. In certain embodiments the symbol sequences are preassigned to corresponding predefined messages. When a message to be encoded is fixed, as in a station ID message, operations 120 and 128 preferably are combined to define a single invariant message symbol sequence.

Operation 124 assigns a plurality of substantially single-frequency code components to each of the message symbols. When the message is encoded, each symbol of the message is represented in the audio data by its corresponding plurality of substantially single-frequency code components. Each of such code components occupies only a narrow frequency band so that it may be distinguished from other such components as well as noise with a sufficiently low probability of error. It is recognized that the ability of an encoder or decoder to establish or resolve data in the frequency domain is limited, so that the substantially single-frequency components are represented by data within some finite or narrow frequency band. Moreover, there are circumstances in which is advantageous to regard data within a plurality of frequency bands as corresponding to a substantially single-frequency component. This technique is useful where, for example, the component may be found in any of several adjacent bands due to frequency drift, variations in the speed of a tape or disk drive, or even as the result of an incidental or intentional frequency variation inherent in the design of a system.

Figure 2A:
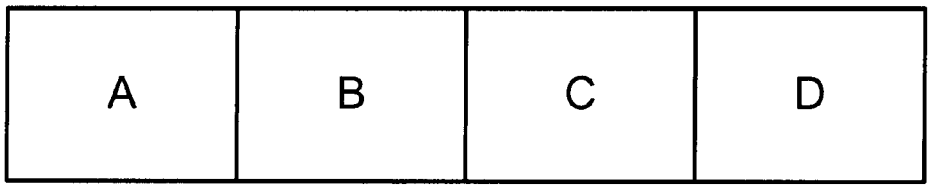
FIGS. 2A and 2B illustrate exemplary symbol sequences for first and second messages, respectively, to be encoded in audio data.
Figure 2B:
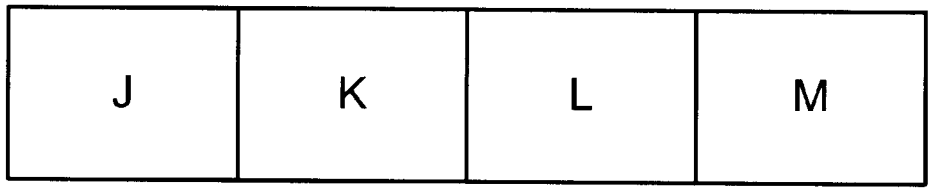

FIGS. 2A through 2D illustrate first and second exemplary messages as specified by certain embodiments of the operations 120, 124 and 128 of FIG. 2. FIG. 2A illustrates a message symbol sequence A, B, C and D specified by operation 128 to encode a first exemplary message to be encoded, while FIG. 2B illustrates a message symbol sequence J, K, L and M specified by operation 128 to encode a second exemplary message. FIG. 2C is a table illustrating an exemplary assignment of four substantially single-frequency components to each of the symbols A, B, C and D. Depending on the application each of the symbols A, B, C and D is represented by a sufficient number of frequency components to insure a sufficiently low probability of error when the symbols are detected, which thus may be more or less than four such frequency components. In certain advantageous embodiments, the frequency components of the symbols A, B, C and D are selected from a predefined set of substantially single-frequency values $f_1$, $f_2$, . . . $f_n$ (where n=16 in this example) so that none of such values is included in more than one of the symbols A, B, C or D. This component assignment scheme provides a particularly effective means of distinguishing each of the symbols A, B, C, and D from all others in the first message. However, in certain other embodiments one or more components are shared among two or more of the symbols of the first message.

FIG. 2D is a table illustrating an assignment of four substantially single-frequency components selected from the same predefined set $f_1$, $f_2$, . . . $f_n$ as in FIG. 2C to the second message symbols J, K, L and M. The frequencies assigned to each of the symbols J, K, L and M are selected from a predefined set so that no more than one substantially single-frequency component included in any of the symbols J, K, L and M is also included in any of the symbols A, B, C and D. However, in certain other embodiments two or more substantially single-frequency components included in ones of the first message symbols are also included in ones of the second message symbols. Moreover, in certain advantageous embodiments, none of the frequency components assigned to any one of the symbols J, K, L and M is included in any other one of such symbols. FIG. 2D illustrates such a frequency assignment scheme. However, in certain other embodiments one or more components are shared among two or more of the symbols of the second message.

In certain advantageous embodiments each of the symbols included in the first message has the same number of frequency components as each of the symbols in the second message. It will be seen from FIGS. 2C and 2D that by assigning the same number of frequency components to all of the symbols in both of the first and second messages, it is possible to optimize the reuse of frequency components between the symbols of the first and second messages, while maintaining complete frequency diversity among the symbols within each of the messages. It will also be seen from the foregoing that this technique which reuses frequency components in symbols of different messages enables the bandwidth of the ancillary data to be doubled when the two messages coexist along the time base of the audio data. In other embodiments, the number of frequency components included in each of the symbols of the first message differs from the number included in each of the second message symbols. In still others, at least two of the message symbols in the first and/or in the second message have differing numbers of frequency components. Moreover, in certain embodiments different numbers of components are included in different symbols of one or both messages.

Figure 2E:
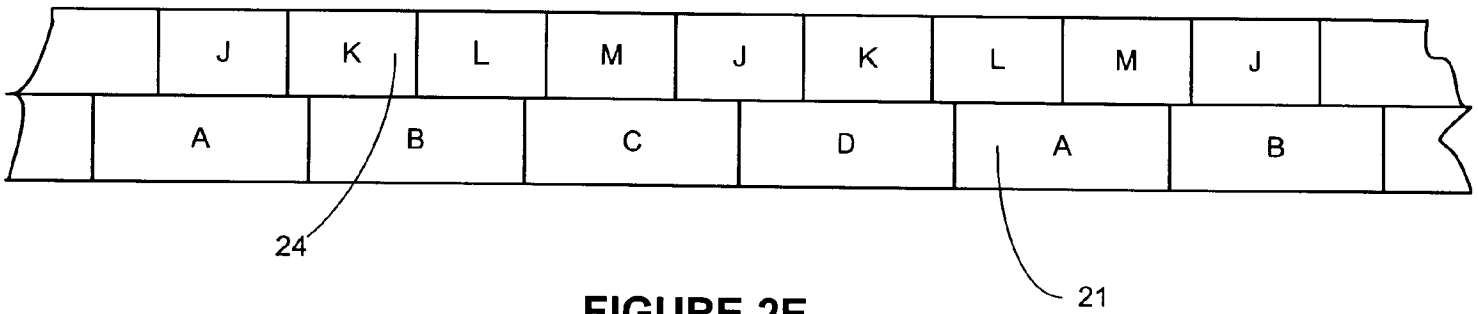
FIGS. 2E through 2I illustrate examples of multiple messages encoded in audio data by means of various embodiments of the present invention.

In certain embodiments several further message parameters are selected singly or in combination in order to ensure that the first and second messages can be separately decoded. Block 132 represents multiple operations which serve to determine parameters of the message to be encoded either to distinguish it from a message previously encoded in the audio data or from one or more further messages also being encoded therein at the same time. One such parameter is the symbol interval, selected in operation 140 of FIG. 2. FIG. 2E illustrates an example of how this operation can be carried out for distinguishing the first and second messages described above in connection with FIGS. 2A–2D. In FIG. 2E, as well as FIGS. 2F–2I, the horizontal dimension represents the time base of the encoded audio data. In certain embodiments one of the first and second messages is already encoded in the audio data when it is received by the encoder. In certain ones of these embodiments, a decoder is included to decode the previously encoded message as an aid to setting the parameters of the message to be encoded. In other embodiments or in alternative modes of operation, both of the first and second messages are encoded in the audio data by the encoder. In this latter case, the received audio data may either be unencoded when received or previously encoded with a further message.

In FIG. 2E, for the first message arranged in a message layer indicated at 21 the intervals for the message symbols A, B, C and D are selected as 0.5 second, while in the second message arranged in a message layer indicated at 24 the intervals for the message symbols J, K, L and M are selected as 0.3 second. By selecting the symbol intervals, as in this example, such that the symbol intervals in one message layer are not an integer multiple of the symbol intervals in the other the symbol intervals in the first and second messages are seldom aligned, so that the two messages are more readily detected separately. However, in other embodiments, different symbol intervals are selected and in some cases symbol intervals are provided for the first message which are integer multiples of symbol intervals in the second message.

Figure 2F:
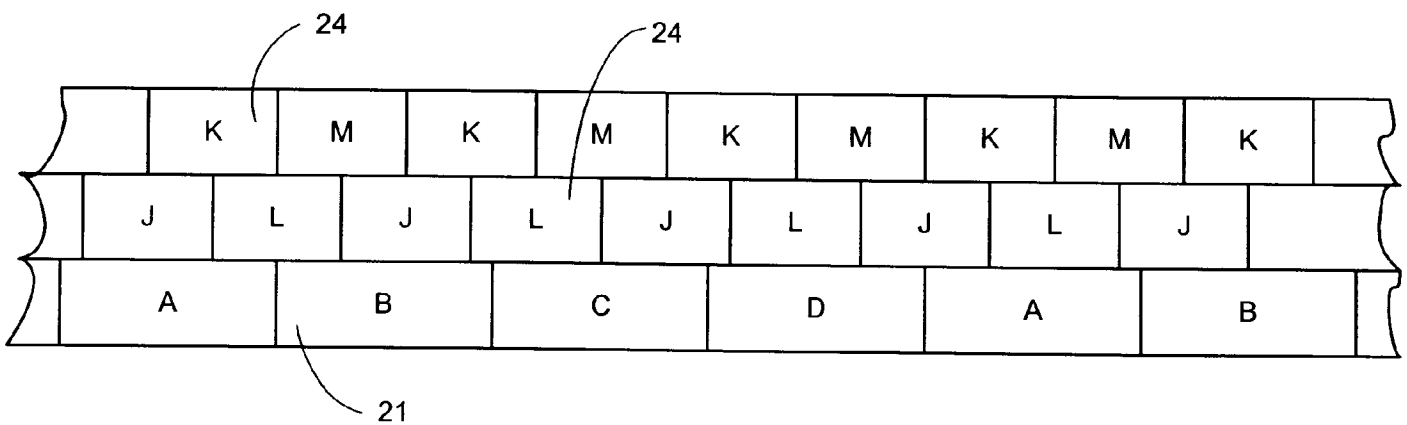
Figure 2G:
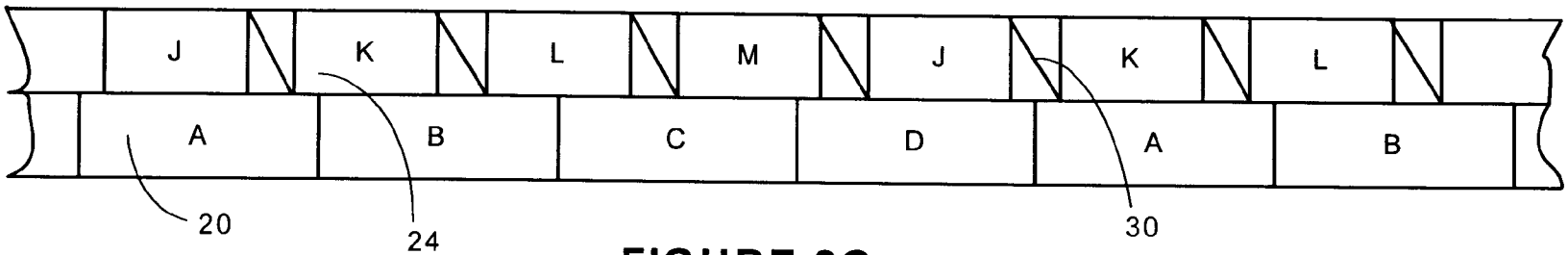

In certain embodiments the intervals of symbols within one or both messages can overlap to provide even greater bandwidth. An example of such a message symbol arrangement effected by the operation 140 is illustrated in FIG. 2F, in which the symbols of the second message have a 50 percent overlap with the each of the following and preceding symbols. In the alternative, the symbols of one or more of the messages may be separated so that gaps are provided between the symbols thereof. An example of this encoding arrangement is provided in FIG. 2G in which the symbols J, K, L and M are separated from one another by gaps 30 along the time base of the audio data.

Figure 2H:
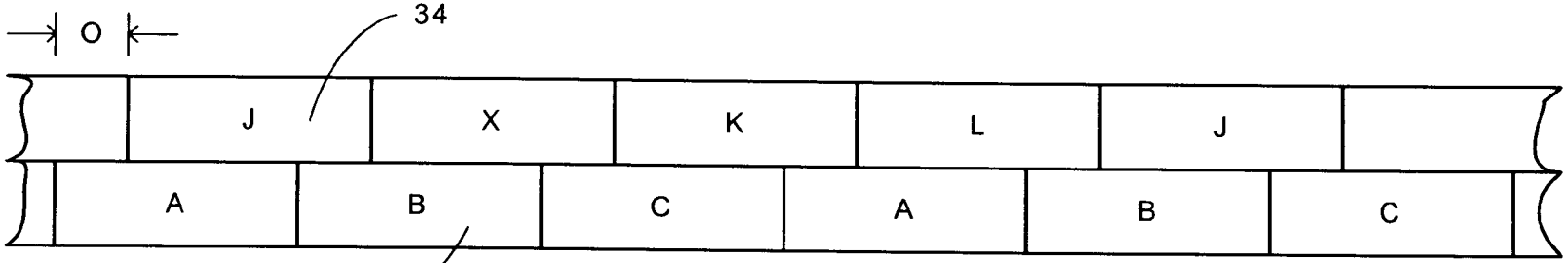

Operation 144 of FIG. 2 provides the ability to introduce an offset between the first and second messages to assist in distinguishing them especially in those embodiments in which the message durations and/or symbol intervals are the same. FIG. 2H illustrates an example of encoding with an offset O between the first message 20 and a modified form of the second message J, X, K and L indicated at 34. Although not required in all applications, the second message includes a marker symbol X which has a fixed position in the message regardless of its informational content and is included through operation 136 in FIG. 2. This enables the receiver/decoder 112 of FIG. 1 to determine the times of occurrence of each of the symbols J, K and L. The marker symbol X, like the other symbols, comprises a combination of substantially single-frequency values selected from the predefined set thereof. Because the offset O between the two messages is fixed and known, it is used along with the marker symbol X by the receiver/decoder 112 in this example to locate the symbols A, B, C and D along the time base and detect them. In certain embodiments the offset O is used without reference to a marker symbol to separately detect the first and second messages.

Figure 2I:
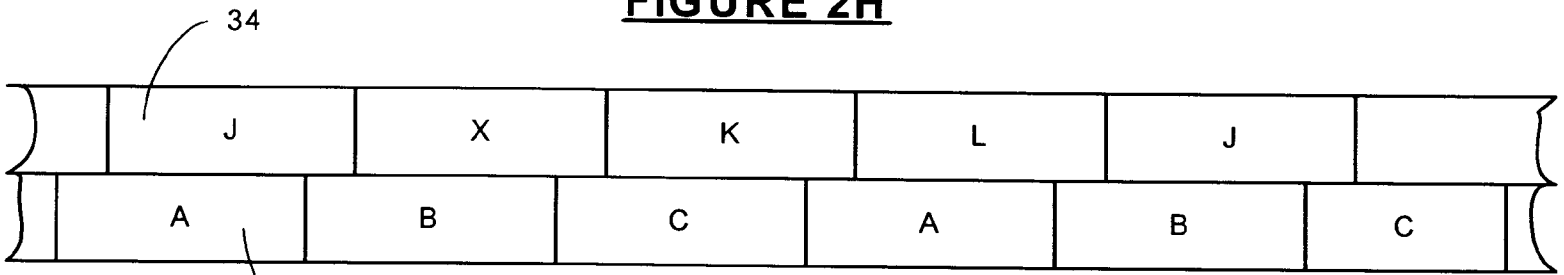

Operation 148 of FIG. 2 determines the duration of each of the messages, either in cooperation with operations 128 and 140 or by inserting padding data, as appropriate. FIG. 2I illustrates an example of encoding two messages having differing message durations but in which the symbol intervals are the same in both messages. A modified first message 38 comprises the symbol sequence A, B and C, coexisting with the modified second message 34 comprising the symbol sequence J, X, K and L. While the symbol intervals are the same in both messages, the differences in their overall durations enable the receiver/decoder 112 to readily distinguish the two messages.

Further advantageous message formatting techniques are disclosed in U.S. patent application Ser. No. 09/318,045 filed May 25, 1999 in the names of Alan R. Neuhauser, Wendell D. Lynch and James M. Jensen, the entire contents of which are incorporated herein by reference.

Figure 3:
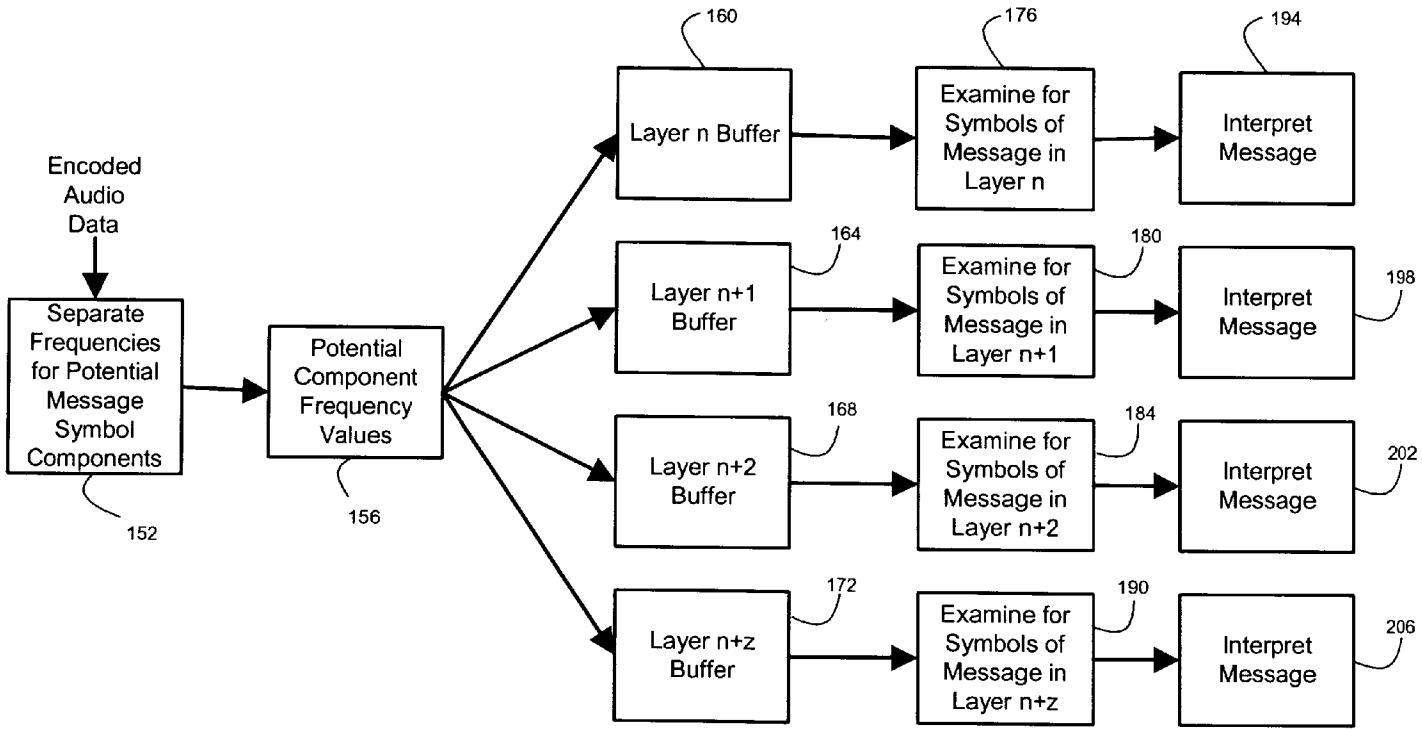
FIG. 3 is an overview of an embodiment of a decoding process and system using multiple buffers in accordance with certain embodiments of the present invention.

FIG. 3 is an overview of decoding processes and systems in accordance with certain embodiments of the invention using multiple buffers to decode multiple messages encoded in audio data.

In an operation 152 the encoded audio data is subjected to one or more processes to separate substantially single-frequency values for the various message symbol components potentially present in the audio data. When the audio data is received in analog form in the time domain (typically uncompressed data), these processes are advantageously carried out by transforming the analog audio data to digital audio data and transforming the latter to frequency domain data having sufficient resolution in the frequency domain to permit separation of the substantially single-frequency components of the potentially-present message symbols. A particularly advantageous implementation employs a fast Fourier transform to convert the data to the frequency domain and then produces signal-to-noise ratios for the substantially single-frequency symbol components that may be present. This implementation is disclosed in U.S. Pat. No. 5,764,763 to Jensen et al. which is incorporated by reference herein in its entirety. One advantage of the multiple message encoding processes described herein which reuse frequency components in the symbols of two or more coexisting messages, such as illustrated in FIGS. 2C and 2D, is the reduction of processing and storage requirements achieved by reducing the number of frequency components that must be detected. This also provides savings in power usage, which is especially important in the case of portable decoders which draw their power from batteries.

When the audio data is received as time-domain digital data, it may be transformed into the frequency domain by any appropriate time-to-frequency domain transformation, as well as by filtering. In certain applications, analog audio data can be transformed into usable frequency domain data by analog filtering.

In an operation 156, the data representing the substantially single-frequency components is distributed to buffers n, n+1, n+2 . . . n+z each of which is dedicated to recovering a particular message encoded in the audio data formatted in a predetermined manner to conform to a respective message layer n, n+1, n+2, . . . n+z. In certain embodiments in which the same message in a given layer is repeated continuously in the audio data and is distinguishable from the messages of the other layers based on its uniquely different message length, the respective buffer dedicated to detecting the messages of this layer is arranged to provide a memory space having a length equal to the length of the message to be decoded.

The component data received by the buffer is stored in a predefined sequence of memory locations until the buffer is filled. Thereafter, the received data is added to the already-stored data values in sequence to accumulate corresponding message symbol components of the message to be detected which are separated in time by integer multiples of the message length. Accordingly, the frequency data of the message to be detected which are separated along the time base of the audio data by integer multiples of the message length are thus combined. Since they will necessarily represent the same symbol components of the message being decoded, they will accumulate to eventually present relatively high values for the components of each respective message symbol of the message being detected. If a message of the respective layer is present, the values stored in the buffer for the symbols of the message will increase with each new message interval, while those of other messages having different message lengths, being misaligned with corresponding frequency values as accumulated in the buffer, will appear noise-like. After a sufficient number of messages have been accumulated in the buffer, the symbols of the desired message whose length conforms to the length of the buffer will stand out sufficiently to permit their identification in a respective operation 194, 198, 202 or 206. Advantageous techniques for interpreting such data are disclosed in U.S. patent application Ser. No. 09/948,283 filed Sep. 7, 2001 in the names of Ronald S. Kolessar and Alan R. Neuhauser, the entire contents of which are incorporated herein by reference.

A respective one of the buffers 176, 180, 184 and 190 is dedicated to decoding the messages of each layer. Accordingly, the length of the memory space in each of the buffers is selected to correspond to the length of the message potentially present in the respective message layer.

Where the messages of the various layers are distinguished by their different respective symbol intervals, the data in the buffers is analyzed for the presence of the respective components of the message symbols to be found in the corresponding message layer which persist for the known symbol interval and exhibit transitions to different message symbols at the boundaries of symbol intervals. This detection technique in certain embodiments is combined with an evaluation or utilization of additional distinguishing message parameters. In certain embodiments, this technique is used in combination with the technique disclosed above which relies on the presence of a distinctly different message length for the messages of each message layer.

In certain embodiments, the distinctly different symbol intervals are used together with the detection of marker symbols characteristic of the respective message layer and having fixed positions in each message, to determine the positions in time of the remaining symbol intervals for determining their identities based on the presence of their respective frequency components within such intervals. In certain embodiments, differing symbol intervals between message layers are used along with a known time offset between the messages of each layer to detect the symbols of multiple layers, as well as to distinguish the symbols of one layer from those of another based on their time characteristics.

Where the messages in their respective layers are distinguished by a fixed offset between the messages, the detection of one or more symbols of any one or more message layers in the buffer data is used along with the known offset to determine the timing of the remaining symbols in both message layers. This timing data is used either to confirm the apparent symbol detections or to isolate symbol intervals for determining symbol identity based on the frequency components present in each symbol interval, or both.

Figure 4:
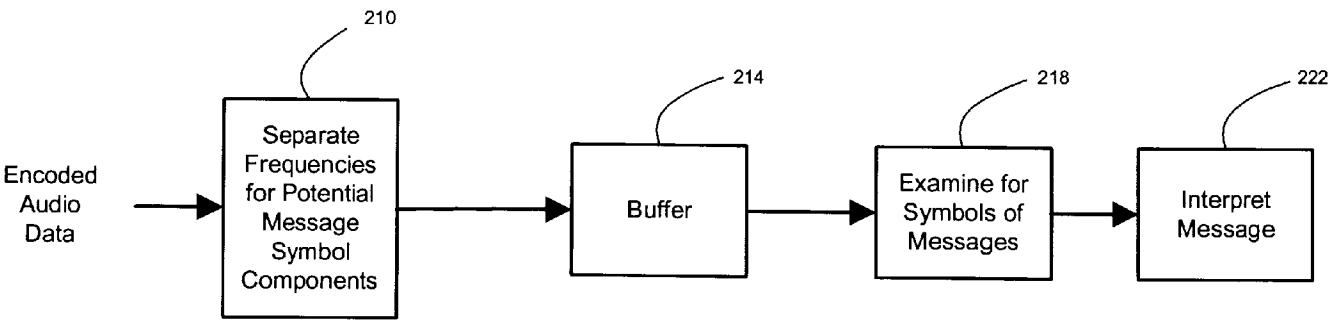
FIG. 4 is an overview of another embodiment of a decoding process and system using a single buffer.

FIG. 4 is an overview of decoding processes and systems in certain embodiments using a single buffer. As in the embodiments of FIG. 3, in an operation 210 the substantially single-frequency values for the various message symbol components potentially present in the audio data are separated therefrom. However, they are stored in a single buffer 214 from which the symbols constituting all of the messages present in the audio data, or which is desired to detect, are detected in an operation 218. From the detected symbols, the information content of the detected messages is extracted in an operation 222.

Figure 5:
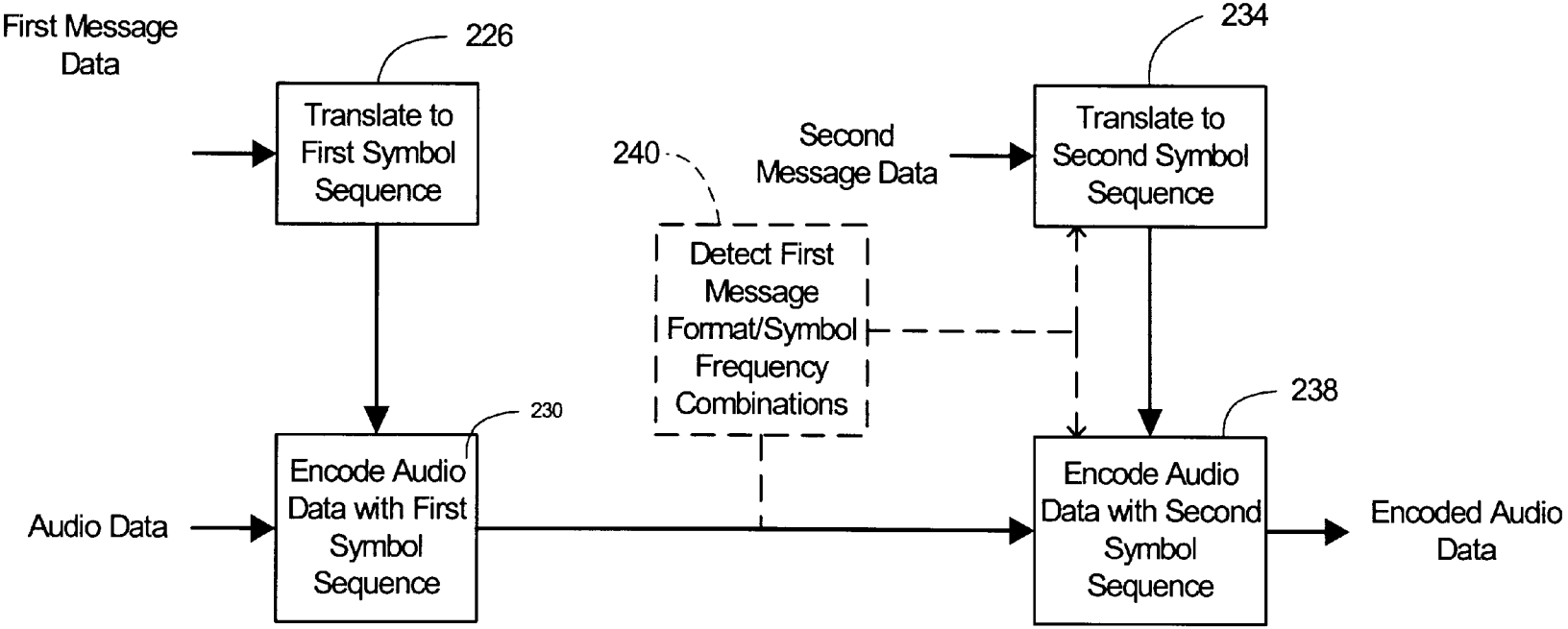
FIG. 5 is an overview of a process for encoding two messages in audio data in accordance with certain embodiments of the present invention.

FIG. 5 is an overview of various embodiments of a method of encoding two messages into audio data. First message data is translated to a first symbol sequence in block 226. Block 230 receives the first symbol sequence from block 226 as well as audio data introduced from another source. The audio data in block 230 is then encoded with the first symbol sequence. The symbol duration, message length, offset and/or frequency content of the first message/symbols are selected to ensure that the message will be distinguishable from any and all other messages encoded or to be encoded in the audio data.

Block 230 then sends the encoded audio data to block 238. Second message data is introduced to block 234 and translated to a second symbol sequence. Block 234 sends the second symbol sequence to block 238. The audio data encoded with the first symbol sequence is then encoded with the second symbol sequence in block 238 so that at least some of the symbols of the second message coexist with at least some of the symbols of the first message along a time base of the audio data. As in the case of the first message, the symbol duration, message length, offset and/or frequency content of the second message/symbols in the second sequence are selected to ensure that the second message will be distinguishable from the first message as well as any and all other messages encoded in or to be encoded in the audio data. In certain embodiments the block 238 imposes a fixed offset between the first and second messages to facilitate their separate detection. Consequently, the encoded audio data leaving block 238 is encoded with two separately detectable and overlapping messages.

In certain embodiments, the encoder 238 is provided with two or more selectable encoding modes each providing an encoded message format differing from other formats available in other encoding modes in at least one of (1) message length, (2) symbol interval, (3) message offset, and (4) symbol frequency content. In certain ones of these embodiments, a detector 240 is provided for detecting either the first symbol sequence included in the audio data from encoder 230 or else its parameters or type of format. The detector 240 provides the detected information to the block 234 and/or block 238 where a message format is selected differing from that of the first message, by selecting at least one of (1) a different symbol interval or intervals than the first message, (2) a different message duration therefrom, (3) a time reference for the second message differing from that of the first, and (4) different combinations of frequency components for the second message symbols than for the first message symbols, to ensure that the first and second messages can be detected separately. In certain embodiments, only one of these four formatting differences is selected to distinguish the second message from the first, while in others two or more are selected for this purpose. The ability to select the message format of the second message in this manner provides the encoder 238 with the ability to adapt to variable encoding environments. In embodiments used to encode a further message in broadcast audio, there may be circumstances in which an encoder at Network B receives a broadcast from Network A to be encoded with a message identifying Network B. Assuming that all network identification messages have a standard format, upon detection of an already-encoded message in the standard network format from Network A encoder 238 will select an alternative encoding format for its network identification message. The same capability can be used where a local station's encoder detects an already-encoded local station identification message in the audio data of a program to be encoded and broadcast.

Figure 6:
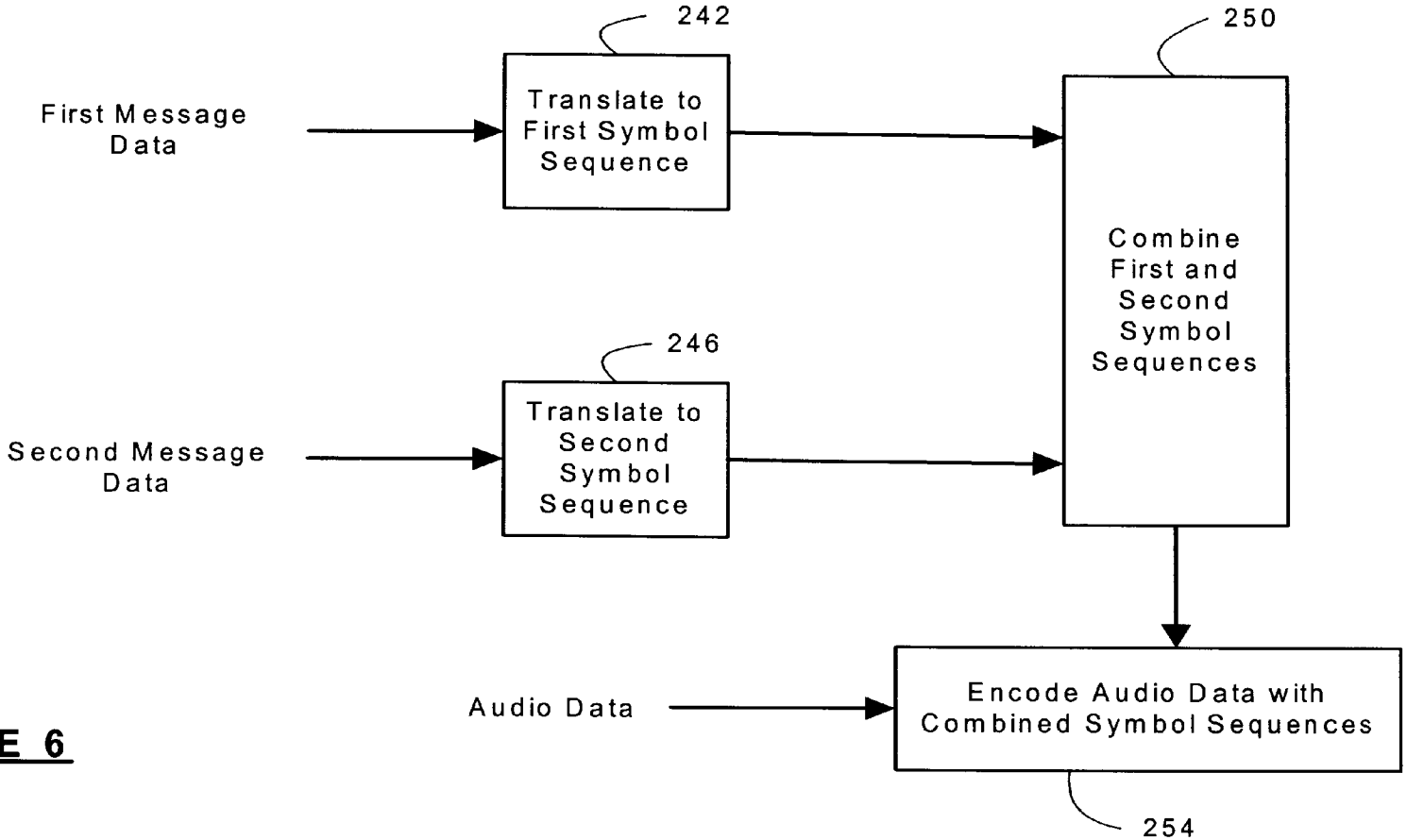
FIG. 6 is an overview of a further embodiment of an encoding process and system for encoding two messages in audio data.

FIG. 6 illustrates various embodiments for encoding two messages into audio data by combining first and second symbol sequences representing first and second messages before encoding the symbol sequences into the audio data. First message data is introduced into block 242, which translates the data into a first symbol sequence including symbol component data representing the identity of the frequency components assigned to each symbol. Second message data is introduced into block 246, which translates the data into a second symbol sequence including data representing the identity of the frequency components assigned to each of its symbols.

The data produced in blocks 242 and 246 are sent to block 250 in which the first and second symbol sequences are combined to produce data representing all of the frequency components to be encoded in the audio data over its time base in order to encode the two messages therein. In certain embodiments in which the symbol sequence data is produced in digital form, the data representing the frequency components is OR'd to yield combined data representing the totality of the frequency components to be encoded in the audio data to encode the two message sequences therein. The results of the combination of the first and second symbol sequences in block 250 are sent to block 254. Block 254 also receives audio data to be encoded with the first and second messages.

The data representing the frequency components to be encoded in the audio data over time controls the encoding process in block 254 to encode the first and second message sequences therein. Where the audio data to be encoded is received as frequency domain data, whether compressed or uncompressed, the data therein representing frequency components of the audio data corresponding to the symbol frequency components being encoded is selected and modified as needed to insert each of the symbol component frequencies therein. In certain embodiments, audio data received in compressed form is first uncompressed. Then one or more messages are encoded therein in accordance with any of the encoding techniques disclosed in this application. The audio data thus encoded is either re-compressed, or else output in uncompressed form.

Figure 7:
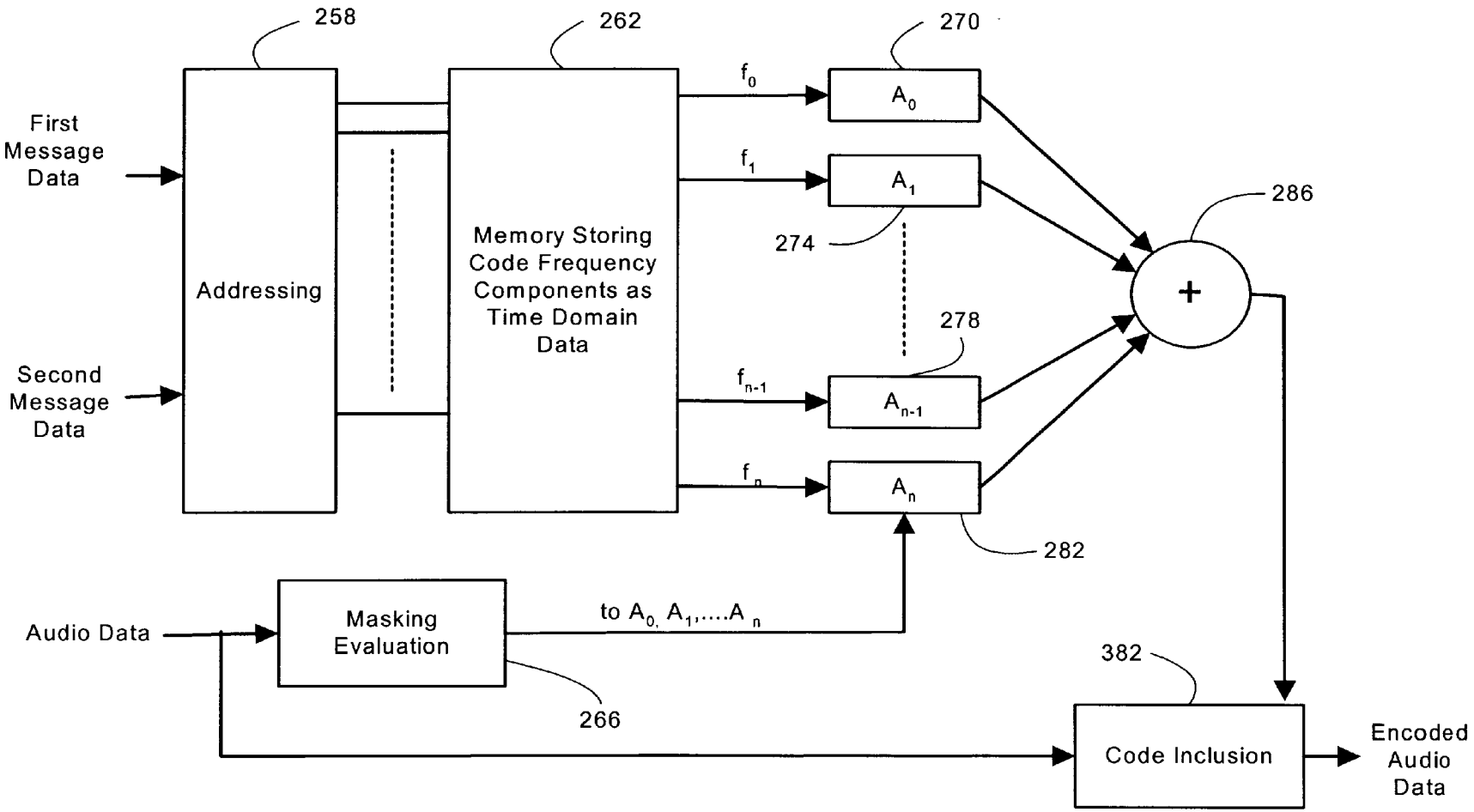
FIG. 7 is an overview of a process and system for encoding multiple messages in time domain audio data in accordance with certain embodiments of the present invention.

FIG. 7 is an overview of certain embodiments in which uncompressed time domain audio data is encoded with first and second messages. In certain ones of these embodiments of the audio data is received in digital form, while in others it is received in analog form. A memory 262 stores time domain data representing all of the frequency components of the symbols that may be included in either of the first or second messages. First and second message data specifying the symbols of the first and second messages is received in an addressing block 258 which responds thereto by sequentially reading out the time domain frequency component data required to represent the symbols of the first and second messages.

Audio data is received in blocks 266 and 382. The audio data sent to block 266 is analyzed for its ability to mask each of the symbol frequency components to be included in the audio data, which results in a set of amplitude factors $A_1$, $A_2$, . . . $A_n$ selected based on the audio data characteristics to ensure that the symbol frequency components to be encoded in the audio data will be maintained inaudible when the encoded audio data is reproduced acoustically. Various advantageous methods of evaluating the masking ability of audio data are disclosed in U.S. Pat. No. 5,764,763, incorporated herein in its entirety. The amplitude factors are applied to the assigned time-domain frequency components read from memory 262 in blocks 270–282. The assigned, inaudible, substantially single-frequency components from blocks 270–282 are mixed in block 286 from which the resulting mixed data is sent to block 382.

In block 382, the original audio data is encoded with the mixed data from block 286, for example, by adding the mixed data to the audio data. The output of block 382 is therefore audio data that is encoded with inaudible first and second messages whose symbols coexist in the time base of the audio data.

Figure 8:
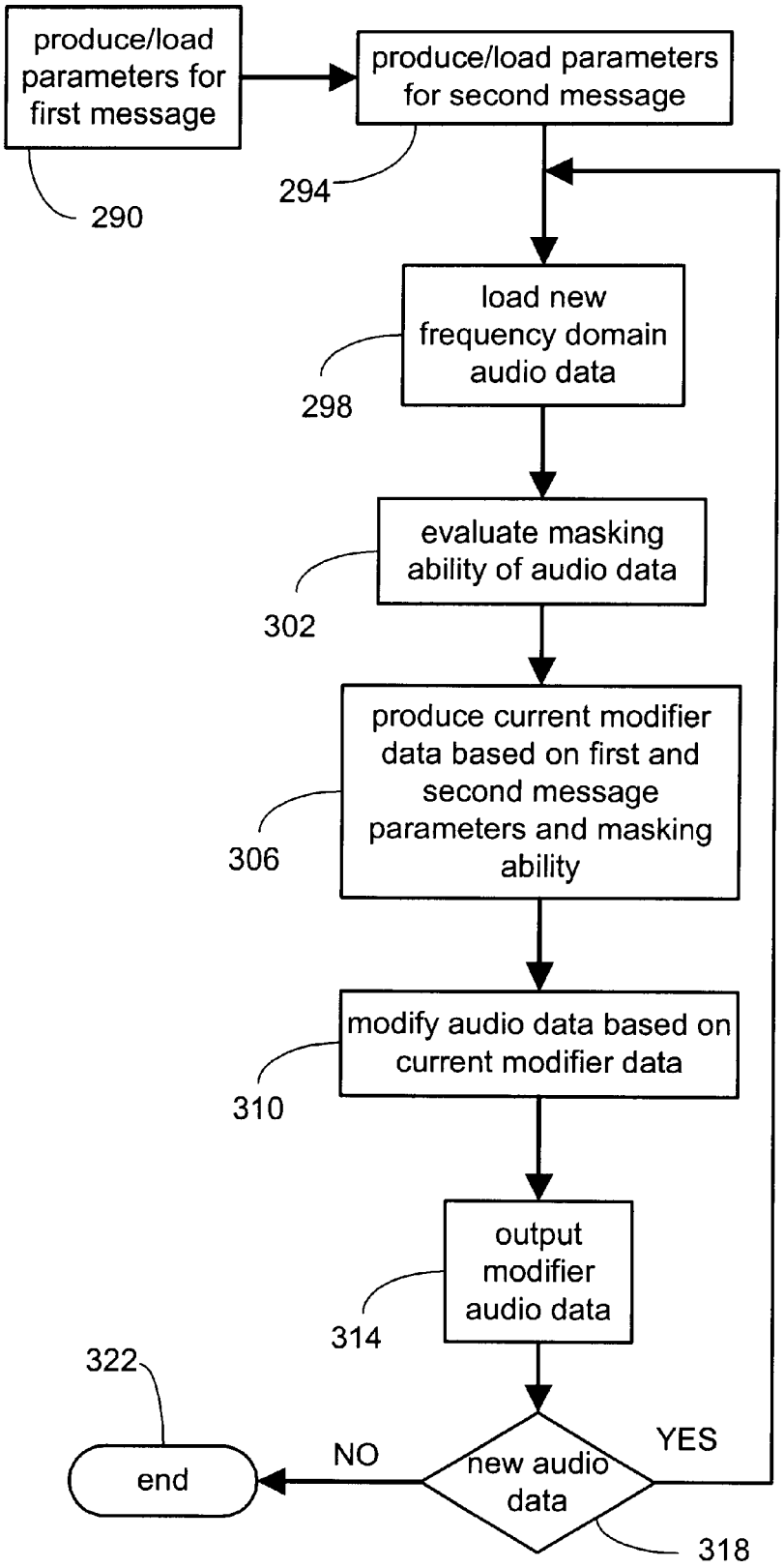
FIG. 8 is an overview of a process in accordance with certain embodiments of the present invention for encoding multiple messages in audio data so that the messages are repeated continuously in the audio data.

FIG. 8 is an overview of a process for encoding two messages in audio data so that they repeat continuously and coexist therein along the time base of the audio data. Repeating encoded messages is an effective way to increase the reliability and accuracy of the encoding/decoding system and method, but since the messages are repeatedly encoded in the audio data as its frequency and amplitude characteristics vary over time, the magnitudes of the frequency components of the message symbols are adjusted to ensure that they remain inaudible in the reproduced audio data. Blocks 290 and 294 introduce the required substantially single-frequency components of the first and second message symbols, respectively, that will be encoded by the system. Block 298 loads new frequency domain audio data into the system for encoding and block 302 evaluates the masking ability of the new frequency domain audio data. Block 306 sets the parameters for the symbol components of the first and second messages based on the analysis in block 302 to produce current modifier data for use in modifying the frequency domain audio data to encode the first and second messages therein while maintaining their inaudibility when the encoded audio data is reproduced acoustically. In block 310, the audio data is encoded with the first and second message and the encoded audio data is output in block 314. Block 318 determines if the loop should start again to continue encoding due to the introduction of new audio data.

Figure 9:
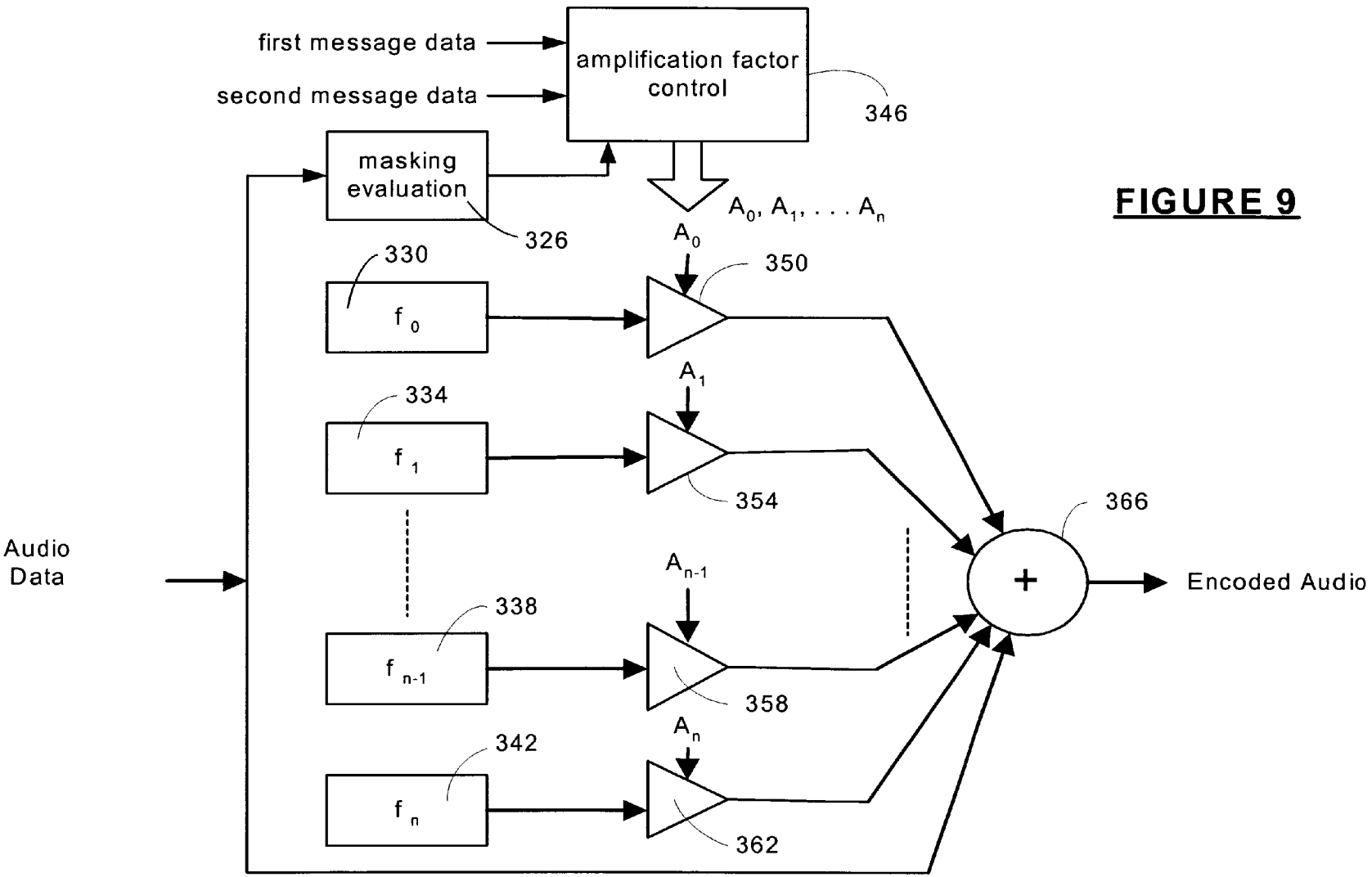
FIG. 9 is an overview of an analog process and system for encoding multiple messages in analog audio data in accordance with certain embodiments of the present invention.

FIG. 9 is an overview of a process and system for encoding multiple messages in analog audio data, in which the messages comprise sequences of symbols each comprising a combination of substantially single-frequency components $f_0$, $f_1$, . . . $f_{n-1}$, $f_n$ produced by analog generators 330, 334, . . . 338, 342. Analog audio data to be encoded is received in blocks 326 and 366. The audio data in block 326 is used to establish the masking requirements for the message symbol components to be added to the audio data. These masking requirements are sent to amplification factor control 346.

Two things happen in block 346. First the masking requirements are turned into amplification factors $A_0$, $A_1$, . . . $A_n$, for adjusting the magnitudes of the components $f_0$, $f_1$, . . . $f_n$. Secondly, the first and second message data is analyzed to determine which of the substantially single-frequency components produced by generators 330, 334, . . . 338 and 342 are to be encoded in the audio data at any given time. All other components (which thus are assigned to message symbols other than those being encoded at that time) are set to zero or any otherwise negligible level through adjustment of their respective amplification factors by the control 346. However, the control 346 assigns values to the amplification factors corresponding to the components to be encoded which will enable these components to be detected by an appropriate decoder while ensuring that they will be inaudible when the audio data is reproduced. Blocks 350–362 then adjust the amplitude levels of the substantially single-frequency components by using the amplitude factors produced in block 346. The outputs of blocks 350–362 are then sent to mixer 366 which encodes the components into the original analog audio data.

Figure 10:
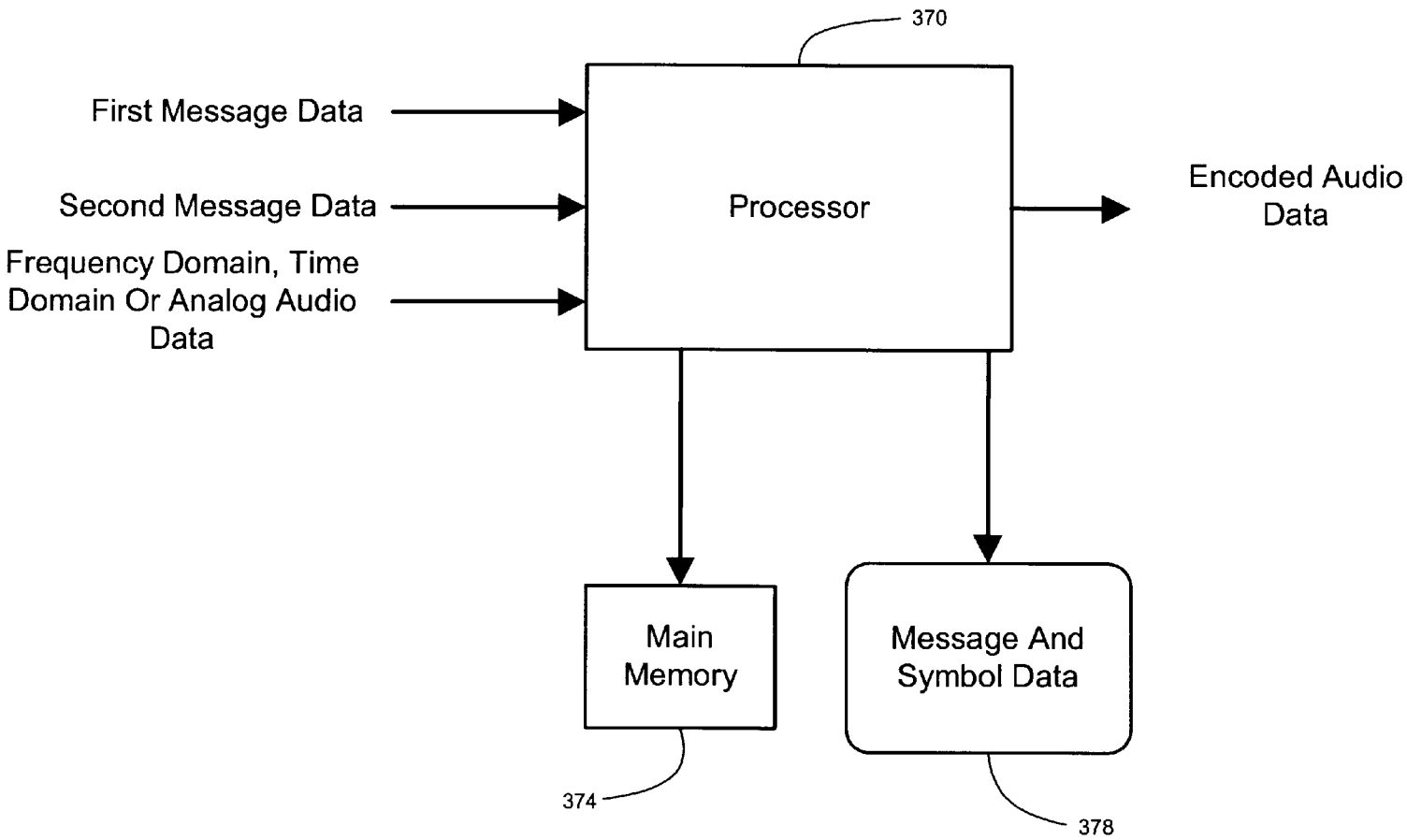
FIG. 10 is an overview of an encoder in accordance with certain embodiments of the present invention implemented by means of a processor.

FIG. 10 is a block diagram of an encoder employing a digital processor 370 operating in accordance with any of the digital encoding techniques described hereinabove. The processor receives audio data in any appropriate form, analog or digital, time domain or frequency domain, compressed or uncompressed. In the case of analog data, it is converted to digital form by the processor 370 for carrying out the encoding process. Parameters for one or more messages to be encoded, including message and symbol data, are stored in permanent storage 378 and retrieved therefrom by the processor 370 before encoding begins. The audio data, as well as temporary values produced by the processor in evaluating the masking capabilities of the audio data and symbol components to be encoded into the audio data, are stored temporarily in a main memory 374. Once the audio data has been encoded, it is output by the processor to be recorded, broadcast or otherwise utilized.

Although the invention has been described with reference to a particular arrangement of parts, features and the like, these are not intended to exhaust all possible arrangements or features, and indeed many other modification and variation will be ascertainable to those of skill in the art.

What is claimed is:

1. A method of encoding audio data with a message, the audio data having a preexisting message encoded therein comprising a sequence of preexisting message symbols, the preexisting message symbols each comprising a distinguishable combination of substantially single-frequency components having frequencies selected from a predefined set of substantially single-frequency values, comprising:

providing data defining a plurality of further message symbols each comprising a combination of substantially single-frequency components selected from the predefined set of substantially single-frequency values distinguishable from the combinations of all others of the further message symbols;

at least some of the substantially single-frequency components included in the further message symbols having the same frequency as at least some of the substantially single-frequency components included in the preexisting message symbols; and encoding the audio data with a further message comprising a sequence of the further message symbols such that at least some of the further message symbols of the further message coexist with at least some of the preexisting message symbols of the preexisting message along a time base of the audio data.

2. The method of claim 1 wherein, at least one of the further message symbols includes two or more substantially single-frequency components also included in a corresponding one of the preexisting message symbols.

3. The method of claim 1 wherein each of the further message symbols includes no more than one substantially single-frequency component also included in any one of the preexisting message symbols.

4. The method of claim 3 wherein all of the preexisting message symbols and the further message symbols have the same number of substantially single-frequency components.

5. The method of claim 3 wherein each of the preexisting message symbols includes no more than one substantially single-frequency component also included in any of the further message symbols.

6. The method of claim 1 wherein each of the preexisting message symbols and the further message symbols has the same number of substantially single-frequency components.

7. The method of claim 1 wherein at least one of the further message symbols has a different number of substantially single-frequency components than at least one of the preexisting message symbols.

8. The method of claim 1 wherein each of the further message symbols has the same number of substantially single-frequency components.

9. The method of claim 1 wherein at least two of the further message symbols have differing numbers of substantially single-frequency components.

10. The method of claim 1 wherein none of the substantially single-frequency components included in any one of the further message symbols is included in any other one of the further message symbols.

11. The method of claim 10 wherein none of the substantially single-frequency components included in any one of the preexisting message symbols is included in any other one of the preexisting message symbols.

12. A method of encoding audio data with a message, the audio data having a preexisting message therein comprising a sequence of preexisting message symbols, the preexisting message symbols each comprising a combination of substantially single-frequency components having frequencies selected from a predefined set of substantially single-frequency values and a predefined symbol interval within a time base of the audio data, comprising:

providing data defining a plurality of further message symbols each comprising a combination of substantially single-frequency values selected from a predefined set of substantially single-frequency values; and encoding the audio data with a further message comprising a sequence of the further message symbols such that at least some of the further message symbols of the further message coexist with at least some of the preexisting message symbols of the preexisting message along the time base of the audio data;

the further message as encoded being arranged within the time base of the audio data so that:

(a) the further message symbols have symbol intervals differing from the symbol intervals of the preexisting message symbols;

(b) the further message has a time offset with respect to the preexisting message; and/or (c) the further message has a duration differing from a duration of the preexisting message.

13. The method of claim 12 wherein encoding the audio data with a further message comprises including a marker symbol in the sequence of further message symbols.

14. The method of claim 13 wherein the marker symbol is a predefined message symbol comprising a combination of substantially single-frequency values selected from the predefined set thereof.

15. The method of claim 12 wherein the further message as encoded is arranged within the time base of the audio data so that the further message symbols have symbol intervals differing from the symbol intervals of the preexisting message symbols.

16. The method of claim 15 wherein the symbol intervals of the further message symbols overlap within the time base of the audio data.

17. The method of claim 15 wherein the symbol intervals of the further message symbols are spaced apart within the time base of the audio data.

18. The method of claim 15 wherein the lengths of the symbol intervals of the preexisting message symbols and the further message symbols are not integer multiples of each other within the time base of the audio data.

19. The method of claim 12 wherein the further message as encoded is arranged within the time base of the audio data so that the further message has a time offset with respect to the preexisting message.

20. The method of claim 19 wherein the durations of the preexisting message and of the further message are substantially the same.

21. The method of claim 12 wherein the further message as encoded is arranged within the time base of the audio data so that the further message has a duration differing from a duration of the preexisting message.

22. The method of claim 21 wherein the symbol intervals of the preexisting message and the further message symbols are substantially the same.

23. The method of claim 12 wherein at least some of the substantially single-frequency components included in the further message symbols have the same frequency as at least some of the substantially single-frequency components included in the preexisting message symbols.

24. The method of claim 12 wherein the audio data to be encoded with a message comprises compressed audio data.

25. The method of claim 24 wherein the compressed audio data comprises data in a frequency domain and encoding the audio data comprises modifying portions of the frequency domain data corresponding to the substantially single-frequency components.

26. The method of claim 12 wherein the audio data to be encoded comprises uncompressed, frequency domain data.

27. The method of claim 26, comprising receiving uncompressed, time-domain audio data and transforming the time-domain audio data to provide uncompressed, frequency domain data.

28. The method of claim 12, wherein the audio data to be encoded comprises time-domain audio data.

29. The method of claim 12 further comprising detecting at least one of the preexisting message and the further message.

30. A method of encoding audio data with first and second messages each comprising a sequence of first and second message symbols, respectively, each comprising a combination of substantially single-frequency components having a frequency selected from a predefined set of substantially single-frequency values, comprising:

providing data defining the first and second message symbols each comprising a combination of substantially single-frequency components selected from the predefined set of substantially single-frequency values distinguishable from the combinations of all others of the first and second message symbols;

at least some of the substantially single-frequency components included in the first message symbols having the same frequency as at least some of the substantially single-frequency components included in the second message symbols; and encoding the audio data with the first and second messages each comprising a sequence of the first and second message symbols such that at least some of the first message symbols of the first message coexist with at least some of the second message symbols of the second message along a time base of the audio data.

31. The method of claim 30, wherein at least one of the first message symbols includes two or more substantially single-frequency components also included in a corresponding one of the second message symbols.

32. The method of claim 30 wherein each of the first message symbols includes no more than one substantially single-frequency component also included in any one of the second message symbols.

33. The method of claim 32, wherein each of the first and second message symbols has the same number of substantially single-frequency components.

34. The method of claim 33, wherein each of the second message symbols includes no more than one substantially single-frequency component also included in any of the first message symbols.

35. The method of claim 30 wherein all of the first message symbols and the second message symbols have the same number of substantially single-frequency components.

36. The method of claim 30 wherein at least one of the first message symbols has a different number of substantially single-frequency components than at least one of the second message symbols.

37. The method of claim 30 wherein each of the first and second message symbols has the same number of substantially single-frequency components.

38. The method of claim 30 wherein at least two of the first and second message symbols have differing numbers of substantially single-frequency components.

39. The method of claim 30, wherein none of the substantially single-frequency components included in any one of the first message symbols is included in any other one of the first message symbols.

40. The method of claim 39, wherein none of the substantially single-frequency components included in any one of the second message symbols is included in any other one of the second message symbols.

41. A method of encoding audio data with a message, the audio data having a preexisting message encoded therein comprising a sequence of preexisting message symbols in a first predetermined format, the preexisting message symbols each comprising a distinguishable combination of substantially single-frequency components selected from a predefined set of substantially single-frequency values, comprising:

detecting the first predetermined format of the preexisting message symbols;

selecting a second predetermined format for encoding a further message in the audio data comprising a sequence of further message symbols so that the second predetermined format of the further message symbols differs from the first predetermined format of the preexisting message symbols, each of the further message symbols comprising a distinguishable combination of substantially single-frequency components selected from the predefined set; and encoding the audio data with the further message symbols in the second predetermined format so that at least some of the further message symbols of the further message coexist with at least some of the preexisting message symbols of the preexisting message along a time base of the audio data.

42. The method of claim 41, wherein the preexisting message symbols have first symbol intervals along the time base of the audio data, and the preexisting message has a predetermined duration and a predetermined time reference on the time base of the audio data; and selecting a predetermined format comprises at least one of (a) selecting second symbol intervals for the further message symbols differing from the first symbol intervals, (b) selecting a second message duration for the further message differing from the predetermined duration of the preexisting message, (c) selecting a further message time reference for the further message on the time base of the audio data differing from the predetermined time reference of the preexisting message, and (d) selecting the distinguishable combinations of the substantially single-frequency components of the further message symbols so that they differ from the distinguishable combinations of the preexisting message symbols.

43. The method of claim 42, wherein selecting a predetermined format comprises selecting second symbol intervals for the further message symbols differing from the first symbol intervals.

44. The method of claim 42, wherein selecting a predetermined format comprises selecting a second message duration for the second message differing from the predetermined duration of the preexisting message.

45. The method of claim 42, wherein selecting a predetermined format comprises selecting a further message time reference for the further message on the time base of the audio data differing from a predetermined time reference of the pre-existing message.

46. The method of claim 42, wherein selecting a predetermined format comprises selecting the distinguishable combinations of the substantially single-frequency components of the further message symbols so that they differ from the distinguishable combinations of the preexisting message symbols.

47. A method of detecting a first message and a second message encoded in audio data as a sequence of first and second message symbols, respectively, at least some of the first message symbols coexisting with at least some of the second message symbols along a time base of the audio data, each of the first and second message symbols comprising a combination of substantially single-frequency components having frequencies selected from a predefined set of substantially single-frequency values, the first message being distinguished from the second message by at least one of (a) differing message symbol intervals along the time base of the audio signal, (b) differing message lengths along the time base of the audio signal, and (c) an offset of the first message from the second message along the time base of the audio signal, comprising:

detecting the first message symbols based on the at least one of differing message symbol intervals of the first and second messages, differing message lengths of the first and second messages and an offset of the first message from the second message; and detecting the second message symbols based on the at least one of differing message symbol intervals of the first and second messages, differing message lengths of the first and second messages and an offset of the first message from the second message.

48. The method of claim 47, wherein detecting the first and second messages comprises producing frequency data representing substantially single-frequency values of the audio data over its time base and examining the frequency data to detect the first and second message symbols therein.

49. The method of claim 48 wherein the first and second messages are repeated periodically in the audio data over its time base and the first and second messages have different respective message lengths, wherein detecting the first message comprises storing the frequency data in a first memory space such that frequency data separated along the time base of the audio data by an integer multiple of the message length of the first message are combined in the first memory space and examining the combined frequency data in the first memory space to detect the first message symbols therein, and wherein detecting the second message comprises storing the frequency data in a second memory space such that frequency data separated along the time base of the audio data by an integer multiple of the message length of the second message are combined in the second memory space and examining the combined frequency data in the second memory space to detect the second message symbols therein.

50. The method of claim 49 wherein the frequency data are combined in the first and second memory spaces by adding values thereof separated along the time base of the audio data by an integer multiple of the first and second message lengths.

51. The method of claim 47 wherein the first and second messages have respectively different message symbol intervals and detecting the first and second message symbols comprises detecting the first and second message symbols based on their respectively different symbol intervals.

52. The method of claim 47 wherein the first and second messages have respectively different message lengths and detecting the first and second message symbols comprises detecting the first and second message symbols based on the respectively different message lengths of the first and second messages.

53. The method of claim 47 wherein the first and second messages are offset along the time base of the audio data and detecting the first and second message symbols comprises detecting the first and second message symbols based on the offset of the first and second messages.

54. A method of encoding audio data with first and second messages each comprising a sequence of first and second message symbols, respectively, comprising:

providing data defining the first and a second message symbols to comprise a combination of substantially single-frequency values selected from a predefined set of substantially single-frequency values; and encoding the audio data with the sequences of first and second message symbols of the first and second messages such that at least some of the first and second message symbols coexist along a time base of the audio data;

the sequences of first and second message symbols as encoded being arranged within the time base of the audio data so that:

(a) the first message symbols have symbol intervals differing from symbol intervals of the second message symbols;

(b) the first message has a time offset with respect to the second message; and/or (c) the first message has a duration differing from the duration of the second message.

55. The method of claim 54, wherein encoding the audio data comprises including a marker symbol in the sequence of the first message symbols.

56. The method of claim 55, wherein the marker symbol is a predefined message symbol comprising a combination of substantially single-frequency values selected from the predefined set thereof.

57. The method of claim 54 wherein the first message as encoded is arranged within the time base of the audio data so that the first message symbols have symbol intervals differing from the symbol intervals of the second message symbols.

58. The method of claim 57 wherein the symbol intervals of the first message symbols overlap within the time base of the audio data.

59. The method of claim 57 wherein the symbol intervals of the first message symbols are spaced apart within the time base of the audio data.

60. The method of claim 57 wherein the symbol intervals of the first message symbols are not integer multiples of the symbol intervals of the second message symbols within the time base of the audio data.

61. The method of claim 54 wherein the first message as encoded is arranged within the time base of the audio data so that the first message has a time offset with respect to the second message.

62. The method of claim 61 wherein the durations of the first and second messages are substantially the same.

63. The method of claim 54 wherein the first message as encoded is arranged within the time base of the audio data so that the first message has a duration differing from a duration of the second message.

64. The method of claim 63 wherein the symbol intervals of the first and second message symbols are substantially the same.

65. The method of claim 54 wherein at least some of the substantially single-frequency components included in the first message symbols have the same frequency as at least some of the substantially single-frequency components included in the second message symbols.

66. The method of claim 54 wherein the audio data to be encoded comprises compressed audio data.

67. The method of claim 66 wherein the compressed audio data comprises data in a frequency domain and encoding the audio data comprises modifying portions of the frequency domain data corresponding to the substantially single-frequency components.

68. The method of claim 54 wherein the audio data to be encoded comprises uncompressed, frequency domain data.

69. The method of claim 68 comprising receiving uncompressed, time-domain audio data and transforming the time-domain audio data to provide uncompressed, frequency domain data.

70. The method of claim 54 wherein the audio data to be encoded comprises time-domain audio data.

71. The method of claim 54 further comprising detecting at least one of the first and second messages.

72. A method of detecting a first message and a second message encoded in audio data as a sequence of first and second message symbols, respectively, at least some of the first message symbols coexisting with at least some of the second message symbols along a time base of the audio data, each of the first and second message symbols comprising a combination of substantially single-frequency components having frequencies selected from a predefined set of substantially single-frequency values, at least some of the substantially single-frequency components included in the first message symbols having the same frequency as at least some of the substantially single-frequency components included in the second message symbols, comprising:

detecting the substantially single-frequency components of the first message symbols, including the substantially single-frequency components thereof having the same frequency as components included in the second message symbols;

detecting the first message symbols based on the detected substantially single-frequency components thereof;

detecting the substantially single-frequency components of the second message symbols, including the substantially single-frequency components thereof having the same frequency as components included in the first message symbols; and detecting the second message symbols based on the detected substantially single-frequency components thereof.

73. A system for encoding audio data with a message, the audio data having a preexisting message encoded therein comprising a sequence of preexisting message symbols, the preexisting message symbols each comprising a distinguishable combination of substantially single-frequency components having frequencies selected from a predefined set of substantially single-frequency values, comprising:

means for providing data defining a plurality of further message symbols each comprising a combination of substantially single-frequency components selected from the predefined set of substantially single-frequency values distinguishable from the combinations of all others of the further message symbols;

at least some of the substantially single-frequency components included in the further message symbols having the same frequency as at least some of the substantially single-frequency components included in the preexisting message symbols; and means for encoding the audio data with a further message comprising a sequence of the further message symbols such that at least some of the further message symbols of the further message coexist with at least some of the preexisting message symbols of the preexisting message along a time base of the audio data.

74. The system of claim 73 wherein the means for encoding is operative to encode at least one of the further message symbols so that it includes two or more substantially single-frequency components included in a corresponding one of the preexisting message symbols.

75. The system of claim 73 wherein the means for encoding is operative to encode each of the further message symbols so that it includes no more than one substantially single-frequency component also included in any one of the preexisting message symbols.

76. The method of claim 75 wherein the means for encoding is operative to encode the further message symbols so that each of the preexisting message symbols and the further message symbols has the same number of substantially single-frequency components.

77. The method of claim 76 wherein the means for encoding encodes the further message symbols so that each of the preexisting message symbols includes no more than one substantially single-frequency component also included in any of the further message symbols.

78. The system of claim 73 wherein the means for encoding encodes the further message symbols so that all thereof have the same number of substantially single-frequency components.

79. The system of claim 73 wherein the means for encoding encodes the further message symbols so that at least one thereof has a different number of substantially single-frequency components than at least one of the preexisting message symbols.

80. The system of claim 73 wherein the means for encoding encodes each of the further message symbols so that it has the same number of substantially single-frequency components as all others of the further message symbols.

81. The system of claim 73 wherein the means for encoding encodes the further message symbols so that at least two of the further message symbols have differing numbers of substantially single-frequency components.

82. The system of claim 73 wherein the means for encoding encodes the further message symbols so that none of the substantially single-frequency components included in any one of the further message symbols is included in any other one of the further message symbols.

83. A system for encoding audio data with a message, the audio data having a preexisting message therein comprising a sequence of preexisting message symbols, the preexisting message symbols each comprising a combination of substantially single-frequency components having frequencies selected from a predefined set of substantially single-frequency values and a predefined symbol interval within a time base of the audio data, comprising:

means for providing data defining a plurality of further message symbols each comprising a combination of substantially single-frequency values selected from a predefined set of substantially single-frequency values; and means for encoding the audio data with a further message comprising a sequence of the further message symbols such that at least some of the further message symbols of the further message coexist with at least some of the preexisting message symbols of the preexisting message along the time base of the audio data;

the further message as encoded being arranged within the time base of the audio data so that:

(a) the further message symbols have symbol intervals differing from the symbol intervals of the preexisting message symbols;

(b) the further message has a time offset with respect to the preexisting message; and/or (c) the further message has a duration differing from a duration of the preexisting message.

84. The system of claim 83 wherein the encoding means is operative to include a marker symbol in the sequence of further message symbols.

85. The system of claim 84 wherein the marker symbol is a predefined message symbol comprising a combination of substantially single-frequency values selected from the predefined set thereof.

86. The system of claim 83 wherein the encoding means is operative to arrange the further message within the time base of the audio data so that the further message symbols have symbol intervals differing from the symbol intervals of the preexisting message symbols.

87. The system of claim 86 wherein the encoding means is operative to encode the further message symbols so that the symbol intervals thereof overlap within the time base of the audio data.

88. The system of claim 86 wherein the encoding means is operative to encode the further message symbols so that the symbol intervals thereof are spaced apart within the time base of the audio data.

89. The system of claim 86 wherein the encoding means is operative to encode the further message symbols so that the lengths of the symbol intervals of the preexisting message symbols and the further message symbols are not integer multiples of each other within the time base of the audio data.

90. The system of claim 83 wherein the encoding means is operative to encode the further message symbols so that the further message as encoded has a time offset with respect to the preexisting message.

91. The system of claim 90 wherein the encoding means is operative to encode the further message symbols so that the durations of the preexisting message and of the further message are substantially the same.

92. The system of claim 83 wherein the encoding means is operative to encode the further message symbols so that the further message as encoded has a duration within the time base of the audio data differing from a duration of the preexisting message therein.

93. The system of claim 92 wherein the encoding means is operative to encode the further message symbols so that the symbol intervals of the preexisting message and the further message symbols are substantially the same.

94. The system of claim 83 wherein the encoding means is operative to encode the further message symbols so that at least some of the substantially single-frequency components thereof have the same frequency as at least some of the substantially single-frequency components included in the preexisting message symbols.

95. The system of claim 83 wherein the encoding means is operative to encode the further message symbols in compressed audio data.

96. The system of claim 95 wherein the compressed audio data comprises data in a frequency domain and the means for encoding the audio data is operative to modify portions of the frequency domain data corresponding to the substantially single-frequency components.

97. The system of claim 83 wherein the encoding means is operative to encode the further message symbols in uncompressed, frequency domain audio data.

98. The system of claim 97 further comprising means for receiving uncompressed, time-domain audio data and transforming the time-domain audio data to provide the uncompressed, frequency domain audio data.

99. The system of claim 83 wherein the encoding means is operative to encode the further message symbols in time-domain audio data.

100. The system of claim 83 further comprising means for detecting at least one of the preexisting message and the further message.

101. A system for encoding audio data with first and second messages each comprising a sequence of first and second message symbols, respectively, each comprising a combination of substantially single-frequency components having a frequency selected from a predefined set of substantially single-frequency values, comprising:

means for providing data defining the first and second message symbols each comprising a combination of substantially single-frequency components selected from the predefined set of substantially single-frequency values distinguishable from the combinations of all others of the first and second message symbols;

at least some of the substantially single-frequency components included in the first message symbols having the same frequency as at least some of the substantially single-frequency components included in the second message symbols; and means for encoding the audio data with the first and second messages each comprising a sequence of the first and second message symbols, respectively, such that at least some of the first message symbols of the first message coexist with at least some of the second message symbols of the second message along a time base of the audio data.

102. The system of claim 101, wherein the means for encoding is operative to encode at least one of the first message symbols so that it includes two or more substantially single-frequency components also included in a corresponding one of the second message symbols.

103. The system of claim 101, wherein the means for encoding is operative to encode the first message symbols so that each thereof includes no more than one substantially single-frequency component also included in any one of the second message symbols.

104. The system of claim 103, wherein the encoding means is operative to encode the first and second message symbols so that each has the same number of substantially single-frequency components as all others thereof.

105. The system of claim 104, wherein the encoding means is operative to encode each of the second message symbols so that each thereof includes no more than one substantially single-frequency component also included in any of the first message symbols.

106. The system of claim 101, wherein the encoding means is operative to encode the first and second message symbols so that all thereof have the same number of substantially single-frequency components.

107. The system of claim 101, wherein the encoding means is operative to encode at least one of the first message symbols so that it has a different number of substantially single-frequency components than at least one of the second message symbols.

108. The system of claim 101, wherein the encoding means is operative to encode the first and second message symbols so that each thereof has the same number of substantially single-frequency components.

109. The system of claim 101, wherein the encoding means is operative to encode the first and second message symbols so that at least two thereof have differing numbers of substantially single-frequency components.

110. The system of claim 101, wherein the encoding means is operative to encode the first message symbols so that none of the substantially single-frequency components included in any one thereof is included in any other one of the first message symbols.

111. The system of claim 110, wherein the encoding means is operative to encode the second message symbols so that none of the substantially single-frequency components included in any one thereof is included in any other one of the second message symbols.

112. A system for encoding audio data with a message, the audio data having a preexisting message encoded therein comprising a sequence of preexisting message symbols in a first predetermined format, the preexisting message symbols each comprising a distinguishable combination of substantially single-frequency components selected from a predefined set of substantially single-frequency values, comprising:

means for detecting the first predetermined format of the preexisting message symbols;

means for selecting a second predetermined format for encoding a further message in the audio data comprising a sequence of further message symbols so that the second predetermined format of the further message symbols differs from the first predetermined format of the preexisting message symbols, each of the further message symbols comprising a distinguishable combination of substantially single-frequency components selected from the predefined set; and means for encoding the audio data with the further message symbols in the second predetermined format so that at least some of the further message symbols of the further message coexist with at least some of the preexisting message symbols of the pre-existing message along a time base of the audio data.

113. The system of claim 112, wherein the preexisting message symbols have first symbol intervals along the time base of the audio data, and the preexisting message has a predetermined duration and a predetermined time reference on the time base of the audio data; and the means for selecting a predetermined format is operative to select at least one of (a) second symbol intervals for the further message symbols differing from the first symbol intervals, (b) a second message duration for the further message differing from the predetermined duration of the preexisting message, (c) a further message time reference for the further message on the time base of the audio data differing from the predetermined time reference of the preexisting message, and (d) the distinguishable combinations of the substantially single-frequency components of the further message symbols so that they differ from the distinguishable combinations of the preexisting message symbols.

114. The system of claim 113, wherein the means for selecting a predetermined format is operative to select the second symbol intervals for the further message symbols so that they differ from the first symbol intervals.

115. The system of claim 113, wherein the means for selecting a predetermined format is operative to select the second message duration for the further message differing from the predetermined duration of the preexisting message.

116. The system of claim 113, wherein the means for selecting a predetermined format is operative to select the further message time reference for the further message on the time base of the audio data so that it differs from the predetermined time reference of the preexisting message.

117. The system of claim 113, wherein the means for selecting a predetermined format is operative to select the distinguishable combinations of the substantially single-frequency components of the further message symbols so that they differ from the distinguishable combinations of the preexisting message symbols.

118. A system for detecting a first message and a second message encoded in audio data as a sequence of first and second message symbols, respectively, at least some of the first message symbols coexisting with at least some of the second message symbols along a time base of the audio data, each of the first and second message symbols comprising a combination of substantially single-frequency components having frequencies selected from a predefined set of substantially single-frequency values, the first message being distinguished from the second message by at least one of (a) differing message symbol intervals along the time base of the audio signal, (b) differing message lengths along the time base of the audio signal, and (c) an offset of the first message from the second message along the time base of the audio signal, comprising:

means for detecting the first message symbols based on the at least one of differing message symbol intervals of the first and second messages, differing message lengths of the first and second messages and an offset of the first message from the second message; and means for detecting the second message symbols based on the at least one of differing message symbol intervals of the first and second messages, differing message lengths of the first and second messages and an offset of the first message from the second message.

119. The system of claim 118 further comprising means for producing frequency data representing substantially single-frequency values of the audio data over its time base and the means for detecting the first message symbols and the means for detecting the second message symbols are operative to examine the frequency data to detect the first and second message symbols therein.

120. The method of claim 119 wherein the first and second messages are repeated periodically in the audio data over its time base and the first and second messages have different respective message lengths, wherein the means for detecting the first message symbols comprises means for storing the frequency data in a first memory space such that frequency data separated along the time base of the audio data by an integer multiple of the message length of the first message are combined in the first memory space and means for examining the combined frequency data in the first memory space to detect the first message symbols therein, and wherein the means for detecting the second message symbols comprises means for storing the frequency data in a second memory space such that frequency data separated along the time base of the audio data by an integer multiple of the message length of the second message are combined in the second memory space and means for examining the combined frequency data in the second memory space to detect the second message symbols therein.

121. The system of claim 120, wherein the means for storing the frequency data in the first and second memory spaces are operative to combine the frequency data in the first and second memory spaces by adding values thereof separated along the time base of the audio data by integer multiples of the first and second message lengths, respectively.

122. The system of claim 118, wherein the first and second messages have respectively different message symbol intervals and the means for detecting the first and second message symbols comprise means for detecting the first and second message symbols based on their respectively different symbol intervals.

123. The system of claim 118, wherein the first and second messages have respectively different message lengths and the means for detecting the first and second message symbols comprise means for detecting the first and second message symbols based on the respectively different message lengths of the first and second messages.

124. The system of claim 118, wherein the first and second messages are offset along the time base of the audio data and the means for detecting the first and second message symbols comprise means for detecting the first and second message symbols based on the offset of the first and second messages.

125. The system of claim 118, wherein the means for detecting the first and second message symbols comprise a processor.

126. A system for encoding audio data with first and second messages each comprising a sequence of first and second message symbols, respectively, comprising:

means for providing data defining the first and second message symbols to comprise a combination of substantially single-frequency values selected from a predefined set of substantially single-frequency values; and means for encoding the audio data with the sequences of first and second message symbols of the first and second messages such that at least some of the first and second message symbols coexist along a time base of the audio data;

the sequences of first and second message symbols as encoded being arranged within the time base of the audio data so that:

(a) the first message symbols have symbol intervals differing from symbol intervals of the second message symbols;

(b) the first message has a time offset with respect to the second message; and/or (c) the first message has a duration differing from the duration of the second message.

127. The system of claim 126, wherein the means for encoding the audio data is operative to include a marker symbol in the sequence of the first message symbols.

128. The system of claim 127, wherein the marker symbol is a predefined message symbol comprising a combination of substantially single-frequency values selected from the predefined set thereof.

129. The system of claim 126, wherein the encoding means is operative to encode the first message symbols having symbol intervals within the time base of the audio data differing from the symbol intervals of the second message symbols.

130. The system of claim 129, wherein the encoding means is operative to encode the first message symbols so that the symbol intervals thereof overlap within the time base of the audio data.

131. The system of claim 129, wherein the encoding means is operative to encode the first message symbols so that the symbol intervals thereof are spaced apart within the time base of the audio data.

132. The system of claim 129, wherein the encoding means is operative to encode the first and second message symbols so that the symbol intervals of the first message symbols are not integer multiples of the symbol intervals of the second message symbols within the time base of the audio data.

133. The system of claim 126, wherein the encoding means is operative to encode the first and second message symbols so that the first message has a time offset with respect to the second message within the time base of the audio data.

134. The system of claim 133 wherein the durations of the first and second messages are substantially the same.

135. The system of claim 126, wherein the encoding means is operative to encode the first message symbols so that the first message has a duration differing from a duration of the second message within the time base of the audio data.

136. The system of claim 135, wherein the symbol intervals of the first and second message symbols are substantially the same.

137. The system of claim 126, wherein the encoding means is operative to encode the first and second message symbols so that at least some of the substantially single-frequency components included in the first message symbols have the same frequency as at least some of the substantially single-frequency components included in the second message symbols.

138. The system of claim 126, wherein the encoding means is operative to encode compressed audio data.

139. The system of claim 138, wherein the compressed audio data comprises data in a frequency domain and the means for encoding is operative to modify portions of the frequency domain data corresponding to the substantially single-frequency components.

140. The system of claim 126, wherein the encoding means is operative to encode uncompressed, frequency domain audio data.

141. The system of claim 140, comprising means for receiving uncompressed, time-domain audio data and means for transforming the time-domain audio data to provide the uncompressed, frequency domain audio data.

142. The system of claim 126, wherein the means for encoding is operative to encode time-domain audio data.

143. The system of claim 126, further comprising means for detecting at least one of the first and second messages.

144. A system for detecting a first message and a second message encoded in audio data as a sequence of first and second message symbols, respectively, at least some of the first message symbols coexisting with at least some of the second message symbols along a time base of the audio data, each of the first and second message symbols comprising a combination of substantially single-frequency components having frequencies selected from a predefined set of substantially single-frequency values, at least some of the substantially single-frequency components included in the first message symbols having the same frequency as at least some of the substantially single-frequency components included in the second message symbols, comprising:

means for detecting the substantially single-frequency components of the first message symbols, including the substantially single-frequency components thereof having the same frequency as components included in the second message symbols;

means for detecting the first message symbols based on the detected substantially single-frequency components thereof;

means for detecting the substantially single-frequency components of the second message symbols, including the substantially single-frequency components thereof having the same frequency as components included in the first message symbols; and means for detecting the second message symbols based on the detected substantially single-frequency components thereof.

* * * * *